US007936326B2

(12) United States Patent
Hashimoto et al.

(10) Patent No.: US 7,936,326 B2
(45) Date of Patent: May 3, 2011

(54) APPARATUS AND METHOD FOR LCD PANEL DRIVE FOR ACHIEVING TIME-DIVISIONAL DRIVING AND INVERSION DRIVING

(75) Inventors: Yoshiharu Hashimoto, Kanagawa (JP); Masayuki Kumeta, Kanagawa (JP); Kouji Matsuura, Kanagawa (JP)

(73) Assignee: Renesas Electronics Corporation, Kanagawa (JP)

( * ) Notice: Subject to any disclaimer, the term of this patent is extended or adjusted under 35 U.S.C. 154(b) by 880 days.

(21) Appl. No.: 11/142,415

(22) Filed: Jun. 2, 2005

(65) Prior Publication Data

US 2006/0007213 A1 Jan. 12, 2006

(30) Foreign Application Priority Data

Jun. 3, 2004 (JP) ..... 2004-165510

(51) Int. Cl.
*G09G 3/36* (2006.01)

(52) U.S. Cl. ..... 345/90; 345/96

(58) Field of Classification Search ..... 345/87, 345/100

See application file for complete search history.

(56) References Cited

U.S. PATENT DOCUMENTS 5,598,180 A * 1/1997 Suzuki et al. ..... 345/100
5,648,792 A * 7/1997 Sato et al. ..... 345/100
6,049,321 A * 4/2000 Sasaki ..... 345/100

FOREIGN PATENT DOCUMENTS

JP 11-327518 A 11/1999
JP 3056085 B2 4/2000
JP 2001166277 A * 6/2001
JP 3433337 B2 5/2003

* cited by examiner

*Primary Examiner* — Amr Awad
*Assistant Examiner* — Waseem Moorad
(74) *Attorney, Agent, or Firm* — Sughrue Mion, PLLC

(57) ABSTRACT

A method is provided for driving a liquid crystal display panel including first and second data line sets each including an even number of arrayed data lines, and a plurality of pixels sharing a common electrode having a constant potential. The method is composed of: time-divisionally selecting data lines from each of the first and second data line sets; and providing data signals on the selected data lines to write the data signals into the pixels therethrough. An order of selecting the data lines from each of the first and second data lines and polarities of the data signals written into the pixels are determined so that polarities of the data signals on the data lines selected from the first data line set are opposite to those of the data lines selected from the second data line set.

21 Claims, 24 Drawing Sheets

Fig. 18

PIXELS ASSOCIATED WITH DATA LINE SET $18_1$

PIXELS ASSOCIATED WITH DATA LINE SET $18_2$

| | $13_{R1}$ | $13_{G1}$ | $13_{B1}$ | $13_{R2}$ | $13_{G2}$ | $13_{B2}$ | $13_{R1}$ | $13_{G1}$ | $13_{B1}$ | $13_{R2}$ | $13_{G2}$ | $13_{B2}$ | |
|---|---|---|---|---|---|---|---|---|---|---|---|---|---|
| m-TH FRAME | + | + | + | + | + | + | − | − | − | − | − | − | ... |
| | − | − | − | − | − | − | + | + | + | + | + | + | |
| | + | + | + | + | + | + | − | − | − | − | − | − | |
| | − | − | − | − | − | − | + | + | + | + | + | + | |
| | + | + | + | + | + | + | − | − | − | − | − | − | |
| | − | − | − | − | − | − | + | + | + | + | + | + | |
| | ⋮ | | | | | | | | | | | | |

+ : POSITIVE POLARITY

− : NEGATIVE POLARITY

| | | | | | | | | | | | | | |
|---|---|---|---|---|---|---|---|---|---|---|---|---|---|
| (m+1)-TH FRAME | − | − | − | − | − | − | + | + | + | + | + | + | ... |
| | + | + | + | + | + | + | − | − | − | − | − | − | |
| | − | − | − | − | − | − | + | + | + | + | + | + | |
| | + | + | + | + | + | + | − | − | − | − | − | − | |
| | − | − | − | − | − | − | + | + | + | + | + | + | |
| | + | + | + | + | + | + | − | − | − | − | − | − | |
| | ⋮ | | | | | | | | | | | | |

APPARATUS AND METHOD FOR LCD PANEL DRIVE FOR ACHIEVING TIME-DIVISIONAL DRIVING AND INVERSION DRIVING

BACKGROUND OF THE INVENTION

1. Field of the Invention

The present invention generally relates to methods and apparatuses for driving liquid crystal display (LCD) panels, more particularly to LCD panel driving techniques employing both time division driving and inversion driving schemes.

2. Description of the Related Art

The time division driving method, which involves time-divisionally writing data signals into pixels through serially selecting data lines (or signal lines), is one of the schemes widely used to drive LCD panels. One advantage of the time division driving method is that the number of output amplifiers to be integrated within an LCD driver is reduced; the time division drive allows driving pixels using a smaller number of output amplifiers than the number of data lines of an LCD panel. The time division driving method is effective to reduce power consumption and the chip size of the LCD driver. Another advantage is that the number of wire lines necessary for providing connections between the LCD driver and the LCD panel is effectively reduced, through adopting an architecture in which data line are selected by switches integrated within the LCD panel. The reduced number of the wire lines between the LCD driver and the LCD panel facilitates the connection between the LCD driver and the LCD panel, and is effective to reduce EMI (electromagnetic interference). Under the circumstances wherein the number of pixels to be provided in LCD panels tends to increase, the increase in the number of data lines to be time divisionally driven is strongly required.

Another scheme widely used to drive an LCD device is an inversion driving scheme. The frame inversion driving involves alternating the polarity of data signals every frame to prevent a "burn-in" of the LCD panel. The frame inversion driving scheme effectively reduces DC (direct current) components of the data signals across the liquid crystal cells, and thereby avoids the "burn-in" of the LCD panel.

The frame inversion driving is schematically classified into the following two drive schemes: the common constant driving scheme and the common inversion driving scheme. The common constant driving scheme involves maintaining the potential of the common electrode of pixels (referred to as the "common potential $V_{COM}$", hereafter) constant while inverting the polarity of the data signals. In contrast, the common inversion driving scheme involves inverting both of the data signals and the common potential. The common constant driving scheme is advantageous in being superior in the stability of the common electrode compared to the common inversion driving scheme. As widely known in the art, the stability in the common potential $V_{COM}$ is important to avoid the occurrence of the flicker. As described below, the present invention concerns the common constant driving method.

As disclosed in Japanese Patent Gazettes Nos. 3433337 and 3056085, for example, the dot inversion driving is a scheme effective for improving the stability of the common potential $V_{COM}$, and thereby reducing the flicker. The dot inversion driving scheme involves writing data signals with opposite polarities into every two adjacent pixels. The adjacent pixels are synchronously written with data signals having the opposite polarities, so that variations in the common potential are effectively suppressed to avoid the occurrence of the flicker.

The time division driving and the dot inversion driving are both advantageous scheme; however, as disclosed in Japanese Open-Laid Patent Application No. H11-327518, the time division driving scheme and the dot inversion driving scheme are not compatible with each other in the case when the number of data lines to be time-divisionally driven by a single amplifier is an even number. In order to avoid the problem, this patent application discloses a technique wherein the number of data lines divisionally driven by a single amplifier is 3″. The following describes the reason why the typical time division driving and dot inversion driving schemes are not compatible with each other in the case that the number of time-divisionally driven data lines is an even number.

FIG. 1 is a view showing an exemplary structure of a typical LCD device 100 that performs time division driving. The LCD device 100 includes an LCD panel 101 and a controller driver 102 that drives the LCD panel 101. The LCD panel 101 is provided with gate lines 111 (scan lines), data lines 112 (signal lines), and pixels 113 arrayed in rows and columns. The pixels 113 each includes a TFT 14 (thin film transistor) and a pixel electrode 115. The pixel electrode 115 opposes a common electrode 116, wherein a liquid crystal cell is formed between the pixel electrode 115 and the common electrode 116. The LCD panel 101 further includes one input terminal 117 for every six data lines 112. The six data lines 112 associated with the same input terminal 117 are collectively referred to as a data line set 118, wherein the six data lines 112 associated with the same data line set 118 are time divisionally driven by one output buffer within the controller driver 102. A set of switches 119 for selecting the data lines 112 are provided between the data lines 112 and the associated input terminals 117.

In this typical LCD device, the switches 119 associated with the same input terminal 117 are sequentially turned on in the order from the one positioned at the end to the one positioned at the other end. This achieves sequentially selecting the data lines 112 associated with the same data line set 118 are sequentially selected in the order from the one positioned at the end to the one positioned at the other end.

According to the dot inversion driving for pixels 113 associated with the same gate line 111, on the other hand, the polarity of the data signals provided for the pixels 113 coupled to the odd-numbered data lines 112 has to be opposite to the polarity of the data signals provided for the pixels 113 coupled to the even-numbered data lines 112.

Consequently, adopting both of the above-mentioned time division driving and dot inversion driving results in that the data signals of the same polarity are supplied to the selected data lines 112. Let us consider the leftmost one of the data lines 112 of the respective data line sets 118, for example, assuming that the data signals of the positive polarity are supplied to the pixels 113 coupled to the odd-numbered data lines 112 and the data signals of the negative polarity are supplied to the pixels 113 coupled to the even-numbered data line 112. As shown in FIG. 2, the typical time division driving scheme involves firstly supplying data signals onto the leftmost one of the data lines 112 within each data line set 118 during the data write operation associated with the selected gate line. The polarities of the data signals supplied to the leftmost data lines 112 are all positive, because the leftmost data lines 112 within the respective data line sets 118 is an odd-numbered data line. This results in that the data signals of the same polarity are supplied to the selected data lines 112. Those skilled in the art would appreciate that this is the case for the other data lines 112.

As shown in FIG. 3, supplying data signals of the same polarity to the selected data lines 112 undesirably develops current flows into the common electrode 116 (or current flows from the common electrode 116), due to the capacitance coupling between the respective data lines 112 and common electrode 116, and this causes undesirable fluctuation of the potential on the common electrode 116. The fluctuation of the potential on the common electrode 116 defeats the technical merit of the dot inversion driving. In other words, the dot inversion driving is not compatible with the time division driving for the configuration having six data lines time being divisionally driven.

Those skilled in the art would appreciate that the same goes for concurrently performing the dot inversion driving and the time division driving which involves time divisionally driving an odd-number of signal lines other than six.

The limitation of the number of data lines to be time-divisionally driven undesirably deteriorates the flexibility of the LCD device design. In particular, the fact that the number of data lines to be time-divisionally driven is restricted to an odd number is not preferable for next generation LCD drivers, which require increase in the number of data lines time to be divisionally driven up to six.

Such problems as described above with an LCD device employing the time division driving scheme would be solved by providing a new technique for suppressing fluctuations in the common potential $V_{COM}$. Under these circumstances, there is a need for providing a technique of suppressing fluctuations in the common potential $V_{COM}$ for the LCD device employing the time division driving scheme.

SUMMARY OF THE INVENTION

In an aspect of the present invention, a method is provided for driving a liquid crystal display panel including first and second data line sets each including an even number of arrayed data lines, and a plurality of pixels sharing a common electrode having a constant potential. The method is composed of:

time-divisionally selecting data lines from each of the first and second data line sets; and providing data signals on the selected data lines to write the data signals into the pixels therethrough. An order of selecting the data lines from each of the first and second data lines and polarities of the data signals written into the pixels are determined so that polarities of the data signals on the data lines selected from the first data line set are opposite to those of the data signals on the data lines selected from the second data line set.

This method effectively stabilizes the potential on the common electrode through writing a set of data lines having opposite polarities at the same time, and thereby improves the image quality of the LCD device.

In another aspect of the present invention, data signals written into all of the pixels associated with the first data line set may have a first polarity during a horizontal period, and data signals written into all of the pixels associated with the second data line set may have a second polarity opposite to the first polarity during the horizontal period. This method is also effective for stabilizing the potential on the common electrode In still another aspect of the present invention, a liquid crystal display device is composed of first and second data line sets each including an even number of data lines; a plurality of pixels sharing a common electrode having a constant potential; a selector circuit designed to time-divisionally select data lines from each of the first and second data line sets, to electrically connect the data line selected from the first data line set with a first input, and to electrically connect the data line selected from the second data line set with a second input; and a driver circuit providing first and second data signals on the first and second inputs, respectively, in synchronization with time divisional selection of the data lines, to thereby write the first and second data signals into associated ones of the pixels. An order of selecting the data lines and polarities of the data signals written into the associated ones of the pixels are determined so that the first and second data signals have opposite polarities.

In still another aspect of the present invention, a liquid crystal display panel is composed of: a gate line; first to n-th data lines arrayed in a horizontal direction along the gate line, n being an even number; (n+1)-th to (2n)-th data lines arrayed in a horizontal direction along the gate line; a plurality of pixels disposed at respective intersections of the gate line and the first to n-th data lines; a first input node; a second input node; first to n-th switches connected between the first input node and the first to n-th data lines; (n+1)-th to (2n)-th switches connected between the second input node and the (n+1)-th to (2n)-th data lines; and first to n-th control signal lines for receiving first to n-th control signals. The first to n-th switches are connected to the first to n-th control lines, respectively. The i-th switch selected out of the (n+1)-th to (2n)-th switches is connected to a control signal line other than i-th signal line of the first to n-th control signal lines.

BRIEF DESCRIPTION OF THE DRAWINGS

The above and other advantages and features of the present invention will be more apparent from the following description taken in conjunction with the accompanied drawings, in which:

FIG. 18 is a conceptual diagram showing the polarities of data signals to be written into the respective pixels in the third embodiment;

DESCRIPTION OF THE PREFERRED EMBODIMENTS

Figure 1:
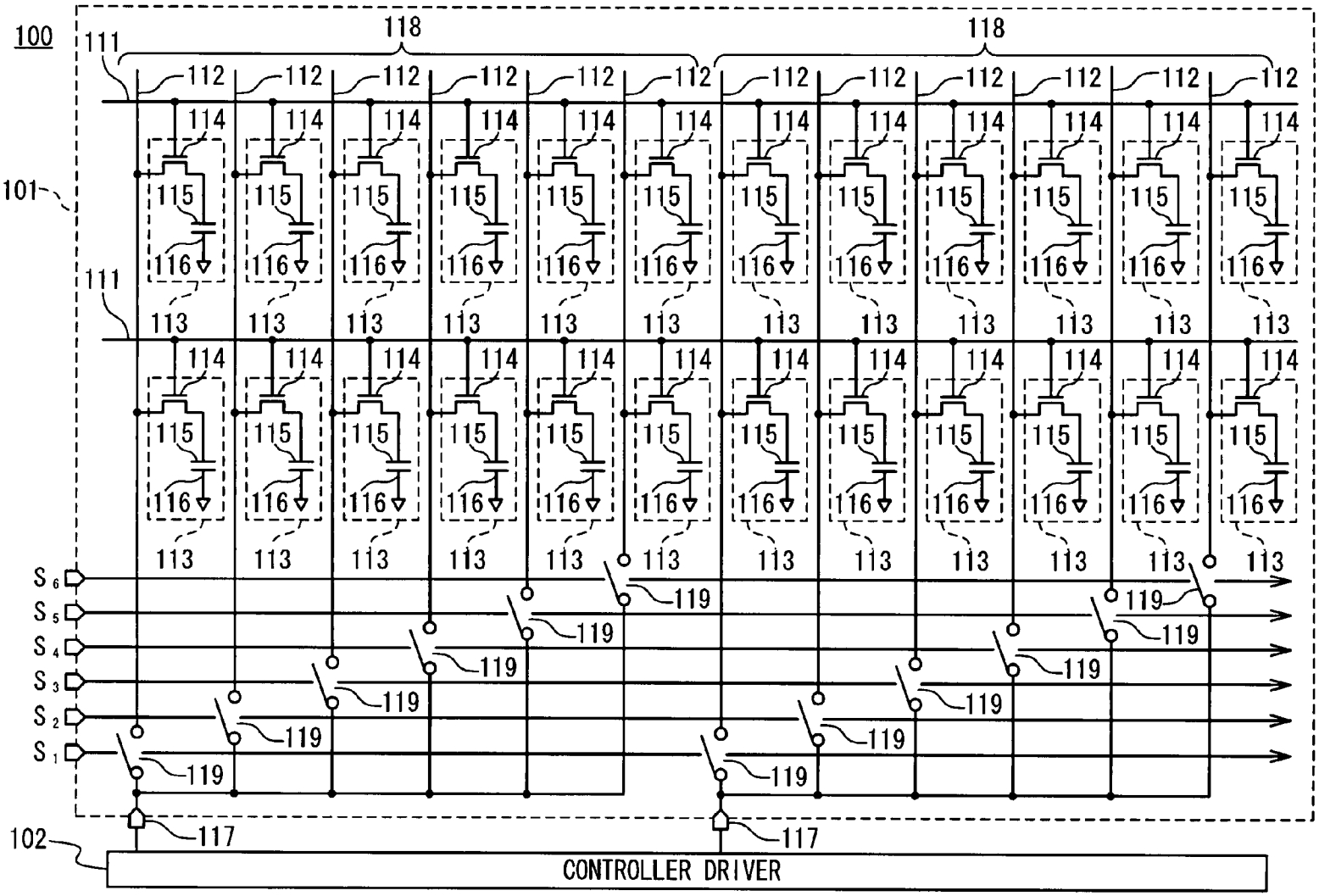
Fig. 1 PRIOR ART
FIG. 1 is a block diagram showing an exemplary structure of a conventional LCD device.
Figure 2:
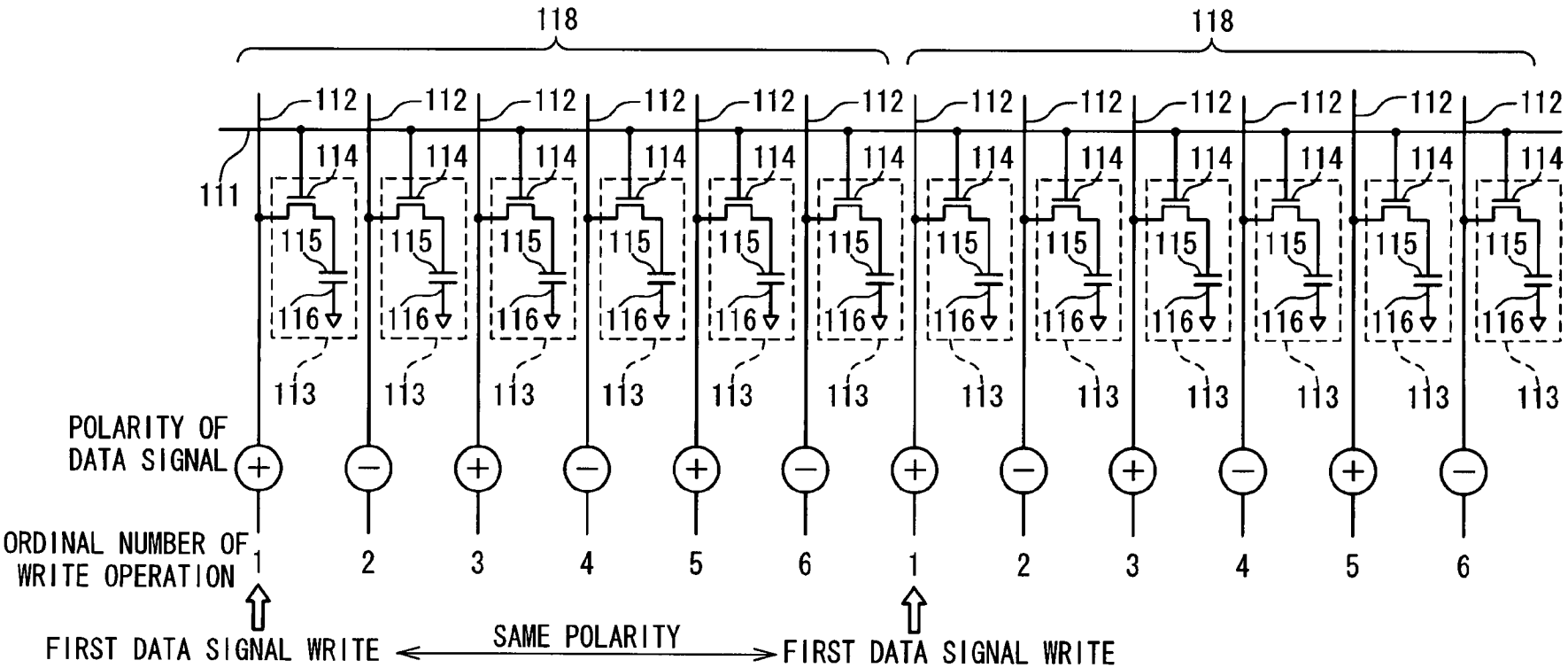
Fig. 2 PRIOR ART
FIG. 2 is a conceptual diagram showing an exemplary procedure of writing data signals into pixels in the conventional LCD device.
Figure 3:
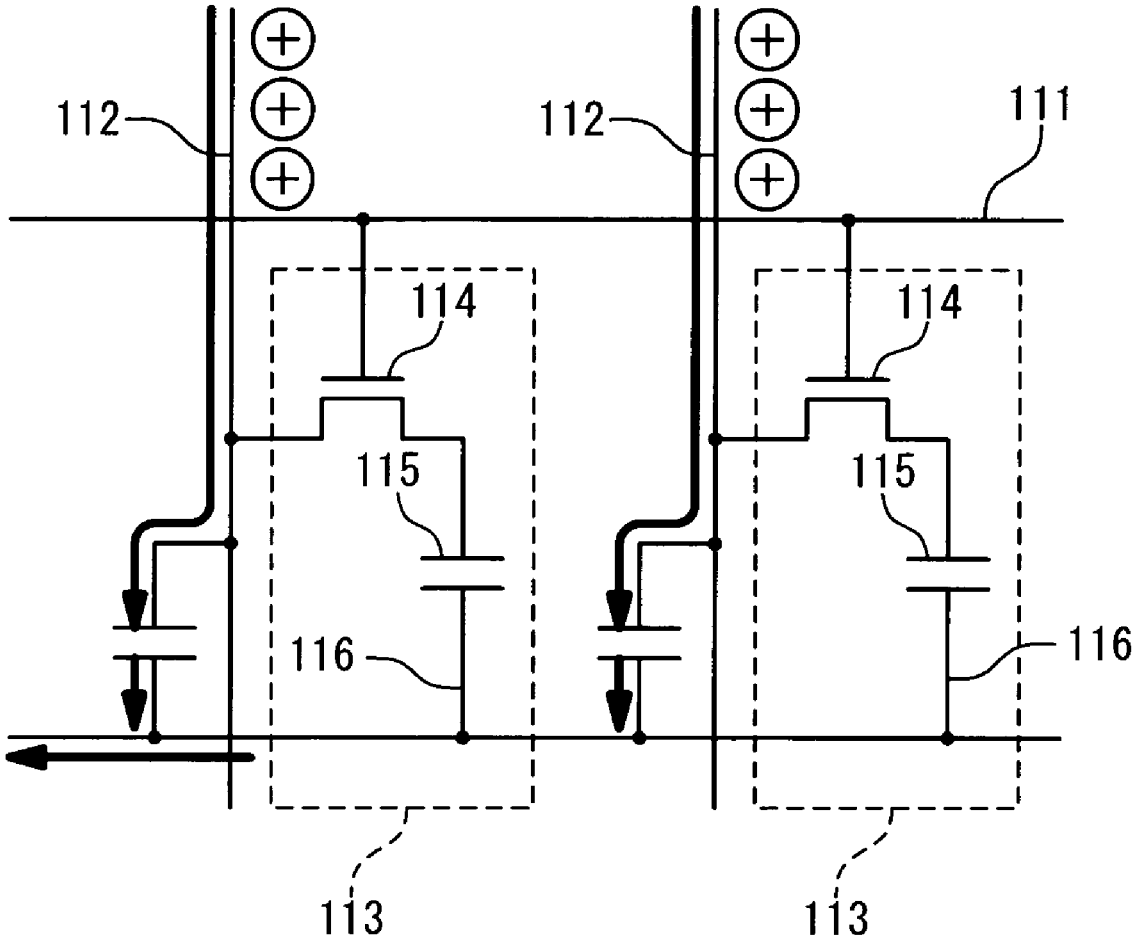
Fig. 3 PRIOR ART
FIG. 3 is a conceptual diagram showing a cause of occurrence of fluctuations in the potential on a common electrode.

The invention will be now described herein with reference to illustrative embodiments. Those skilled in the art would recognize that many alternative embodiments can be accomplished using the teachings of the present invention and that the invention is not limited to the embodiments illustrated for explanatory purposed. It should be noted that, same reference numerals denote same or similar members in the drawings, wherein reference numerals may be attached with subscripts for identifying one member from another.

First Embodiment

1. LCD Device Structure

Figure 4:
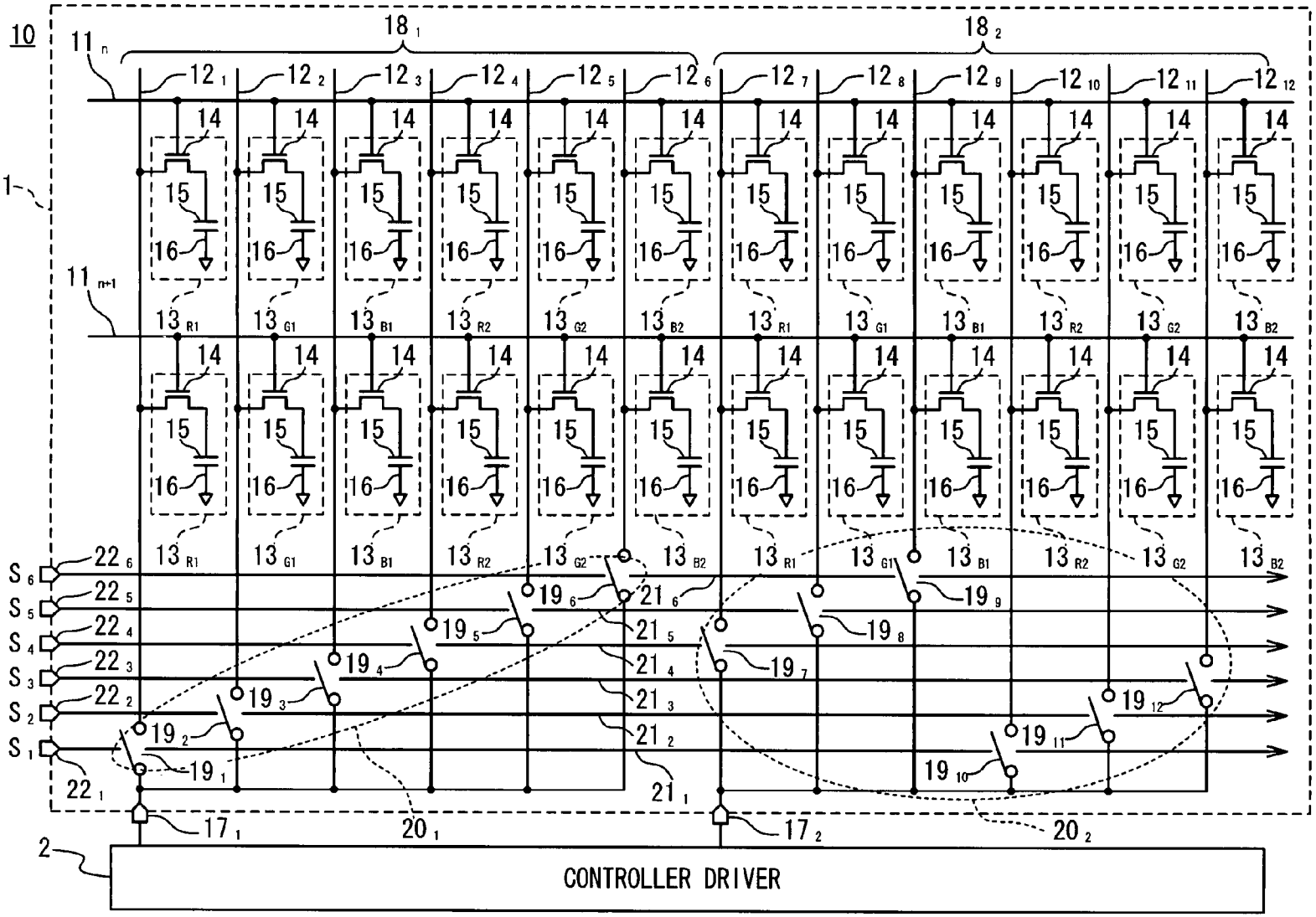
FIG. 4 is a block diagram showing an exemplary structure of an LCD device in a first embodiment of the invention.

FIG. 4 is a block diagram showing an exemplary structure of an LCD device 10 in a first embodiment of the present invention. The LCD device 10 includes an LCD panel 1 and a controller driver 2. The controller driver 2 is used to drive the LCD panel 1.

The LCD panel 1 includes gate lines 11 (two shown), data lines 12 (two shown), and pixels 13 arrayed in rows and columns.

The LCD panel 1 is configured to display images on the basis of the RGB colorimetric system. The pixels 13 are each associated with selected one of the "R" (red), "G" (green), and "B" (blue) colors. The colors with which the respective pixels 13 are associated are determined such that the pixels 13 positioned in the same column, that is, the pixels coupled to the same data line 12, are associated with the same color. More specifically, the pixels 13 coupled to the data lines $\mathbf{12}_1$, $\mathbf{12}_4$, $\mathbf{12}_7$, $\mathbf{12}_{10}$, . . . are "R" pixels associated with the red color; the pixels 13 coupled to the data lines $\mathbf{12}_2$, $\mathbf{12}_5$, $\mathbf{12}_8$, $\mathbf{12}_{11}$, . . . are "G" pixels associated with the green color; and the pixels 13 coupled to the data lines $\mathbf{12}_3$, $\mathbf{12}_6$, $\mathbf{12}_9$, $\mathbf{12}_{12}$, . . . are "B" pixels associated with the blue color.

It should be noted that the R pixels 13 coupled to the data lines $\mathbf{12}_1$ and $\mathbf{12}_7$ may be denoted by the reference numeral "$\mathbf{13}_{R1}$", and the R pixels 13 coupled to the data lines $\mathbf{12}_4$ and $\mathbf{12}_{10}$ may be denoted by the reference numeral $\mathbf{13}_{R2}$, if necessary, to thereby clarify the associations between the pixels 13 and the colors. The symbol "R" within the subscripts represents the color associated therewith, and the number subsequent to the symbol "R" is used to identify the columns of the pixels 13. Correspondingly, the G pixels 13 coupled to data lines $\mathbf{12}_2$ and $\mathbf{12}_8$ may be denoted by the reference numeral "$\mathbf{13}_{G1}$", and the G pixels 13 coupled to the data lines $\mathbf{12}_5$ and $\mathbf{12}_{11}$ may be denoted by the reference numeral "$\mathbf{13}_{G2}$". Furthermore, the B pixels 13 coupled to the data lines $\mathbf{12}_3$ and $\mathbf{12}_9$ may be denoted by the reference numeral $\mathbf{13}_{B1}$, and the B pixels 13 coupled to the data lines $\mathbf{12}_6$ and $\mathbf{12}_{12}$ may be denoted by the reference numeral "$\mathbf{13}_{B2}$".

The pixels 13 each include a TFT 14 and a pixel electrode 15. The TFT 14 has a drain coupled to the associated data line 12 and has a source coupled to the pixel electrode 15. The gate of the TFT 14 is coupled to the associated gate line 11, so that the TFT 14 provides an electrical connection between the associated data line 12 and the pixel electrode 15 in response to the potential level on the associated gate line 11. The pixels 13 share a common electrode 16 so that the pixel electrode 15 within each pixel 13 opposes the common electrode 16. Liquid crystal is filled between the pixel electrode 15 and the common electrode 16, thereby forming a liquid crystal cell. The common electrode 16 is coupled to a common-potential generation circuit (not shown), wherein the common electrode 16 is maintained at a predetermined common potential $V_{COM}$.

The LCD panel 1 is further provided with input terminals 17 that receive data signals for driving the respective pixels 13 from the controller driver 2. It should be noted that the LCD device 100 is designed to implement time-divisional driving, and therefore the association of the input terminals 17 with the data lines 12 is not a one-to-one association. The six data lines 12 associated with the same input terminal 17 is collectively referred to as the data line set 18.

The data lines 12 are connected to the associated input terminals 17 through switches 19 that select the data lines 12 to be electrically connected to the associated input terminals 17. More specifically, the data lines $\mathbf{12}_1$ to $\mathbf{12}_6$ are connected to the input terminal $\mathbf{17}_1$ through the switches $\mathbf{19}_1$ to $\mathbf{19}_6$, respectively, and the data lines connected to the input terminal $\mathbf{17}_1$ are selectable by using the switches $\mathbf{19}_1$ to $\mathbf{19}_6$, respectively. Correspondingly, the data lines $\mathbf{12}_7$ to $\mathbf{12}_{12}$ are connected to the input the terminal $\mathbf{17}_2$ through the switches $\mathbf{19}_7$ to $\mathbf{19}_{12}$, respectively, and the data lines connected to input terminal $\mathbf{17}_2$ are selectable by using the switches $\mathbf{19}_7$ to $\mathbf{19}_{12}$.

The six switches 19 connected to the same input terminal 17 may be collectively referred to as the switch set 20, hereinafter. Specifically, the switch set $\mathbf{20}_1$ is composed of the switches $\mathbf{19}_1$ to $\mathbf{19}_6$, and the switch set $\mathbf{20}_2$ is composed of the switches $\mathbf{19}_7$ to $\mathbf{19}_{12}$.

A set of six control lines 21 are provided within the LCD panel 1, which are used to turn on or off the respective switches 19. Each of the switches 19 is connected to any one of six control lines 21. The control lines $\mathbf{21}_1$ to $\mathbf{21}_6$ are connected to control input terminals $22_1$ to $22_6$, respectively, and receive control signals $S_1$ to $S_6$ from the controller driver 2 through the control input terminals $22_1$ to $22_6$. The switches 19 connected to the control line $21_1$ are responsive to the control signal $S_1$ to be turned on or off, and the switches 19 connected to the control line $21_2$ are responsive to the control signal $S_2$ to be turned on or off. The same goes for the switches 19 connected to the other control lines 21.

The connections of the switches 19 to the control lines 21 are different in the adjacent switch sets 20. Specifically, in the switch set $20_1$, the leftmost switches $19_1$ are connected to the control line $21_1$; the second switch $19_2$ from the left is connected to the control line $21_2$; and similarly, third to sixth switches $19_3$ to $19_6$ from the left are, respectively, connected to the control lines $21_3$ to $21_6$. In the switch set $20_2$, on the contrary, fourth, fifth, and sixth switches $19_{10}$, $19_{11}$, and $19_{12}$ from the left are connected to control lines $21_1$, $21_2$, and $21_3$, respectively, and first, second, and third switches $19_7$, $19_8$, and $19_9$ from the left are connected to control lines $21_4$, $21_5$, and $21_6$, respectively. As described further below, the difference in the connections of the switches 19 to the control lines 21 in the adjacent switch sets 20 is important to prevent fluctuations in common potential $V_{COM}$.

Figure 5:
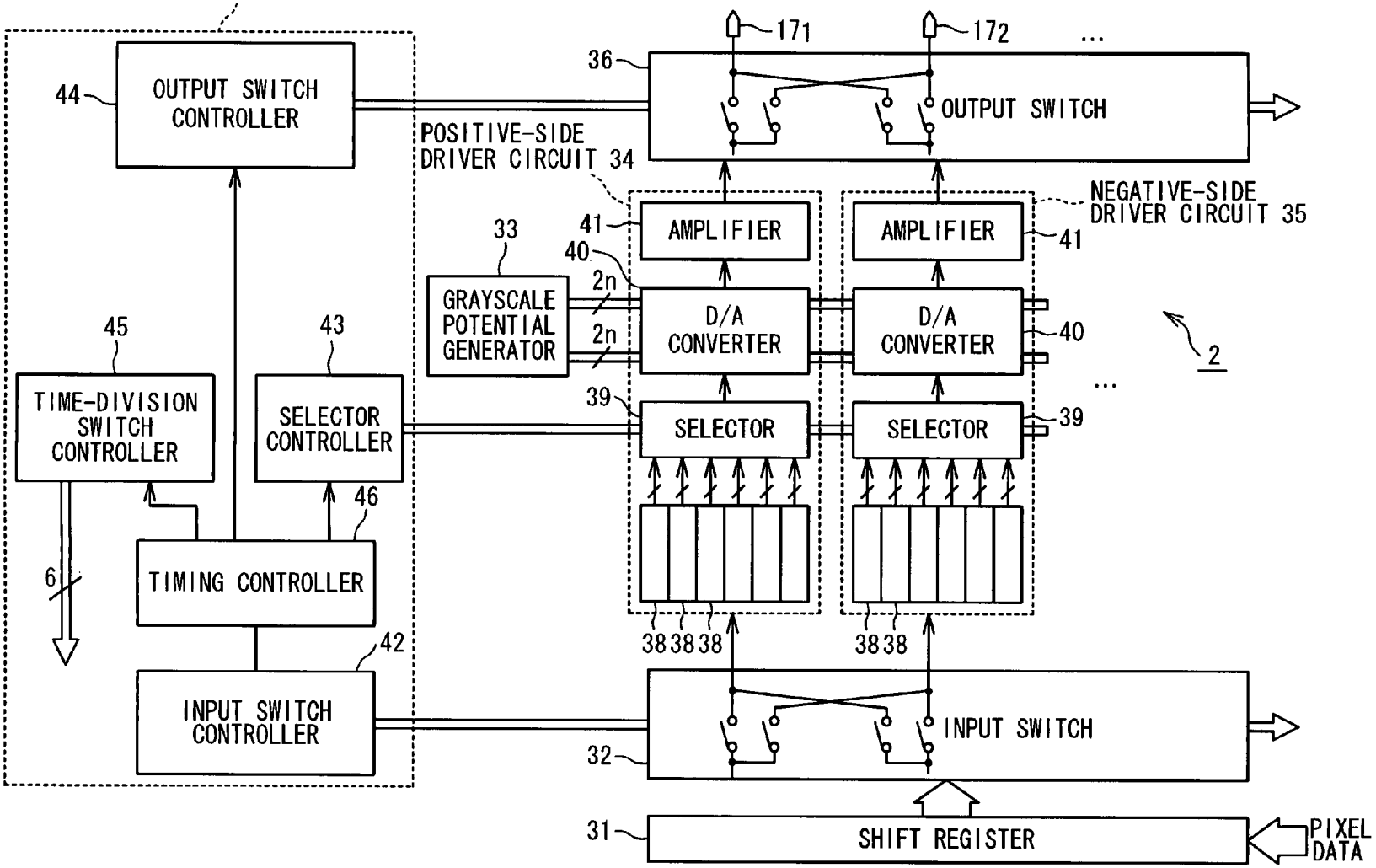
FIG. 5 is a block diagram showing an exemplary structure of a controller driver within the LCD device in the first embodiment.

FIG. 5 is a block diagram showing an exemplary structure of the controller driver 2 in this embodiment. The controller driver 2 is designed to provide data signals onto the input terminals 17 so that the polarities of the data signals developed on the adjacent input terminals 17 are opposite. It should be noted that the polarities of the data signals are defined using the common potential $V_{COM}$ as the reference potential; the polarity of a specific data signal is defined to be positive when the potential of the specific data signal is higher than the common potential $V_{COM}$. Correspondingly, the polarity of another certain data signal is defined to be negative when the potential thereof is lower than the common potential $V_{COM}$.

Schematically, the controller driver 2 is composed of a shift register 31, an input switch circuitry 32, a grayscale potential generator 33, a set of positive-side drive circuits 34 (one shown), a set of negative-side drive circuits 35 (one shown), an output switch circuitry 36, and a controller circuitry 37. It should be noted that the positive-side and negative-side drive circuits 34 and 35 must be understood to be alternately arranged in FIG. 5.

The shift register 31 is used to temporarily store the pixel data associated with the respective pixels 13. When the pixels 13 on a specific line are selected, pixel data for the selected pixels 13 are retained in the shift register 31.

The input switch circuitry 32 is used to switch the destination of each pixel data stored in the shift register 31. The input switch circuitry 32 transfers pixel data associated with the pixels 13 to be driven with data signals of the positive polarity to the associated positive-side drive circuits 34, while transferring pixel data associated with the pixels 13 to be driven with data signals of the negative polarity to the associated negative-side drive circuits 35.

The grayscale potential generator 33 provides grayscale potential signals, associated with grayscale levels, respectively, for the positive-side drive circuit 34 and the negative-side drive circuit 35. In the case that the pixel data is each composed of n data bits, the number of grayscale potential signals being supplied to each of the positive-side drive circuits 34 and the negative-side drive circuits 35 is $2^n$, wherein the signal levels of the grayscale potential signals are different from one another. The signal levels of the grayscale potential signals supplied to the positive-side drive circuits 34 are all higher than the common potential $V_{COM}$; that is, the polarities of the grayscale potential signals supplied to the positive-side drive circuits 34 are all positive. The signal levels of the grayscale potential signals supplied to the negative-side drive circuits 34, on the other hand, are all lower than the common potential $V_{COM}$; that is, the polarities of the grayscale potential signals supplied to the negative-side drive circuits 34 are all negative.

The positive-side and negative-side drive circuits 34 and 35 are designed to generate data signals for driving the associated pixels 13. The positive-side drive circuits 34 are used to develop data signals of the positive polarity, and the negative-side drive circuits 35 are used to develop data signals of the negative polarity. One positive-side drive circuit 34 and one negative-side drive circuit 35 are provided for every two input terminals 17 of the LCD panel 1.

In detail, the positive-side drive circuits 34 each include a set of six latches 38, a selector 39, a D/A (digital/analog) converter 40, and an amplifier 41. The latches 38 stores the associated pixel data of the pixels 13 received from the shift register 31. The selector 39 selects one of the associated latches 38 and transfers the pixel data stored in the selected latch to the D/A converter 40. The D/A converter 40 is responsive to the pixel data received from the selector 39 for selecting one of the $2^n$ grayscale potential signals received from the grayscale potential generator 33, and outputs the selected grayscale potential signal to the amplifier 41. It should be noted that the polarity of the signal outputted from the D/A converter 40 within the positive-side drive circuit 34 is positive, since the polarity of the selected grayscale potential signal is also positive (defined using the common potential $V_{COM}$ as the reference potential). The amplifier 41 is configured of a source follower circuit that provides impedance conversion to thereby develop the data signal for the selected pixel 13 in response to the grayscale potential signal supplied thereto. The potential of the data signal developed by the amplifier 41 is substantially identical to the selected grayscale potential signal supplied to the amplifier 41.

The negative-side drive circuits 35 substantially have the same configuration as the positive-side drive circuits 34. The difference of the negative-side drive circuits 35 from the positive-side drive circuits 34 is that the polarities of the grayscale potential signals supplied to the D/A converters 40 are negative, and therefore data signals of the negative polarity are developed by the negative-side drive circuits 35.

The output switch circuitry 36 switches the destinations of the data signals developed by the positive-side drive circuits 34 and the negative-side drive circuits 35 to thereby output the data signals to the desired ones of the input terminals 17. For example, a data signal outputted from one of the adjacent positive-side and negative-side drive circuits 34 and 35 is supplied to one of the adjacent input terminals $17_1$ and $17_2$ associated therewith, and another data signal outputted from the other one of the relevant driver circuits 34 and 35 is supplied to the other one of input terminals $17_1$ and $17_2$.

The controller circuitry 37 provides controls for the above-described input switch circuitry 32, the grayscale potential generator 33, the positive-side drive circuits 34, the negative-side drive circuits 35, and the output switch circuitry 36. More specifically, the controller circuitry 37 includes an input switch controller 42, a selector controller 43, an output switch controller 44, a time-division switch controller 45, and a timing controller 46. The input switch controller 42 controls the input switch circuitry 32, and thereby allows the pixel data contained in the shift register 31 to be transferred to the desired latches 38. The selector controller 43 controls the selectors 39 within the positive-side and negative-side drive circuits 34 and 35, to thereby transfer the desired pixel data to the D/A converters 40. The output switch controller 44 controls the output switch circuitry 36 to transfer the data signals to the desired input terminals 17. The time-division switch controller 45 generates the control signals $S_1$ to $S_6$ to allow the desired switches 19 within the LCD panel 1 to be turned on. The timing controller 46 provides timing controls for the input switch controller 42, the selector controller 43, the output switch controller 44, and the time-division switch controller 45. More specifically, the timing control circuit 46 controls the timing with which the input switch circuitry 32 switches the transfer destinations of the pixel data, the timing with which the selectors 39 switch the pixel data to be transferred to the D/A converters 40, the timing with which the output switch circuitry 36 switches the destinations of the data signals, and the timing with which the time-division switch control circuit 45 switches the switches 19 to be turned on.

It is to be understood that the structure of the controller driver 2 is not limited to the configuration of FIG. 5. In an alternative embodiment, in which the controller driver 2 includes a frame memory, the shift register 31 may be removed from the controller driver 2. In this case, the pixel data are supplied to the latches 38 within the positive-side and negative-side drive circuits 34 and 35 through the input switch circuitry 32. In another embodiment, level shifters may be additionally provided between the selectors 39 and the D/A converters 40 to enlarge the allowable signal level range of the grayscale potential signals supplied to the D/A converters 40. The level shifters are used to provide signal level matching between the selectors 39 and the D/A converters 40.

2. Operation of the LCD Device

Figure 6:
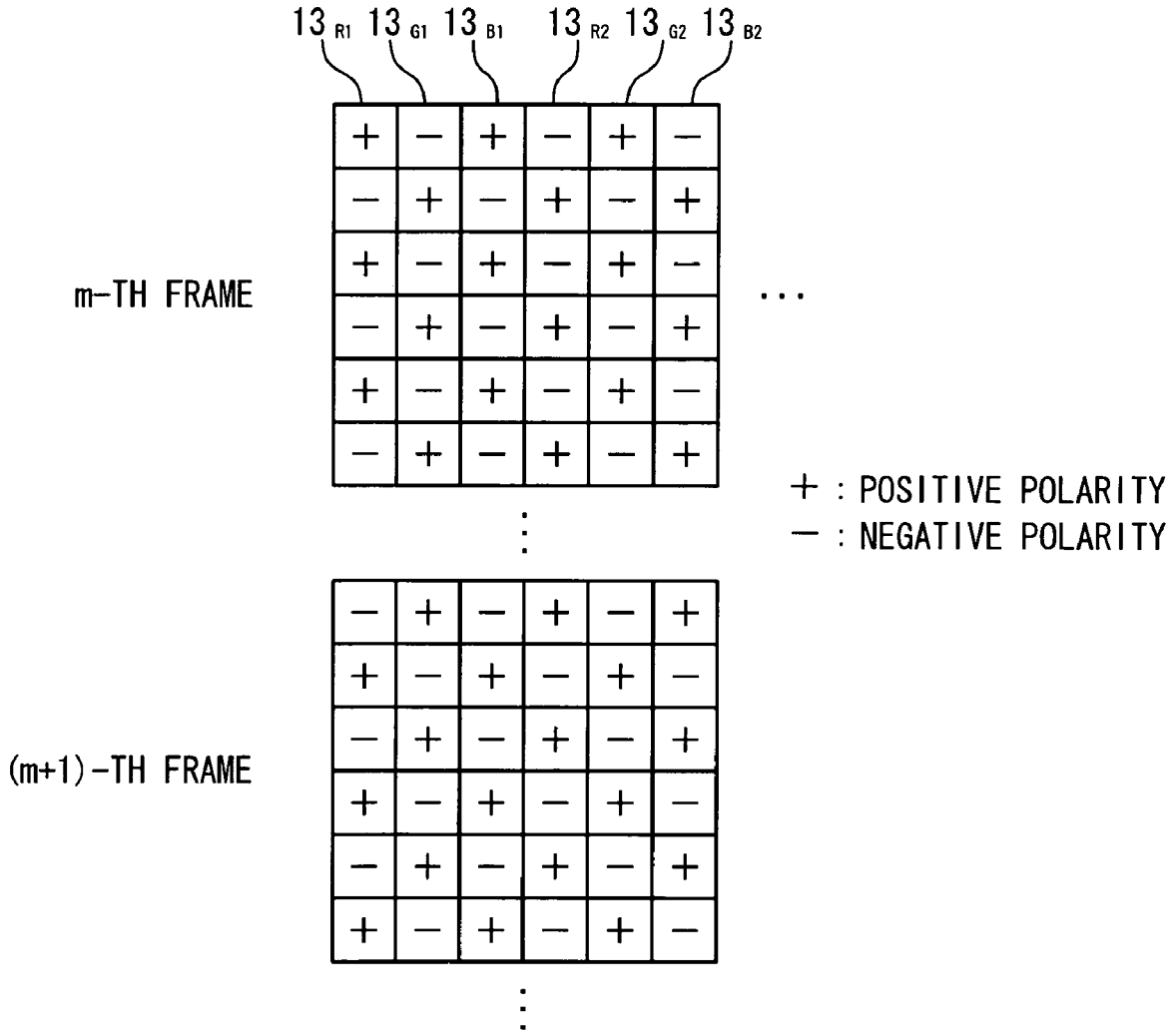
FIG. 6 is a view showing the polarities of data signals written into the respective pixels in the first embodiment.

Schematically, the operation of the LCD device 10 in this embodiment addresses implementing dot inversion driving and time division driving at the same time, while achieving the stabilization of the common potential $V_{COM}$. Referring to FIG. 6, in order to achieve dot inversion driving, data-signal writing into the pixels 13 is performed such that the polarities of data signals to be written into the pixels 13 in odd-numbered columns are opposite to those of data signals to be written into the pixels 13 in even-numbered columns. In addition, writing the data signals into the pixels 13 is performed such that the polarities of the data signals being written into two arbitrary pixels 13 adjacent to each other in the vertical direction (direction in which the data lines 12 extend) are opposite to each other. The polarity of the data signal provided to each pixel is inverted every frame. Furthermore, in order to achieve time division driving, the data lines 12 are serially and time divisionally selected, and the associated data signals are time-divisionally supplied to the desired pixels 13 through the selected data lines 12.

Additionally, the LCD device 10 in this embodiment is designed to develop the data signals to be written into the pixels 13, so that the data signals applied to the selected data lines 12 include both of positive and negative data signals.

Figure 7:
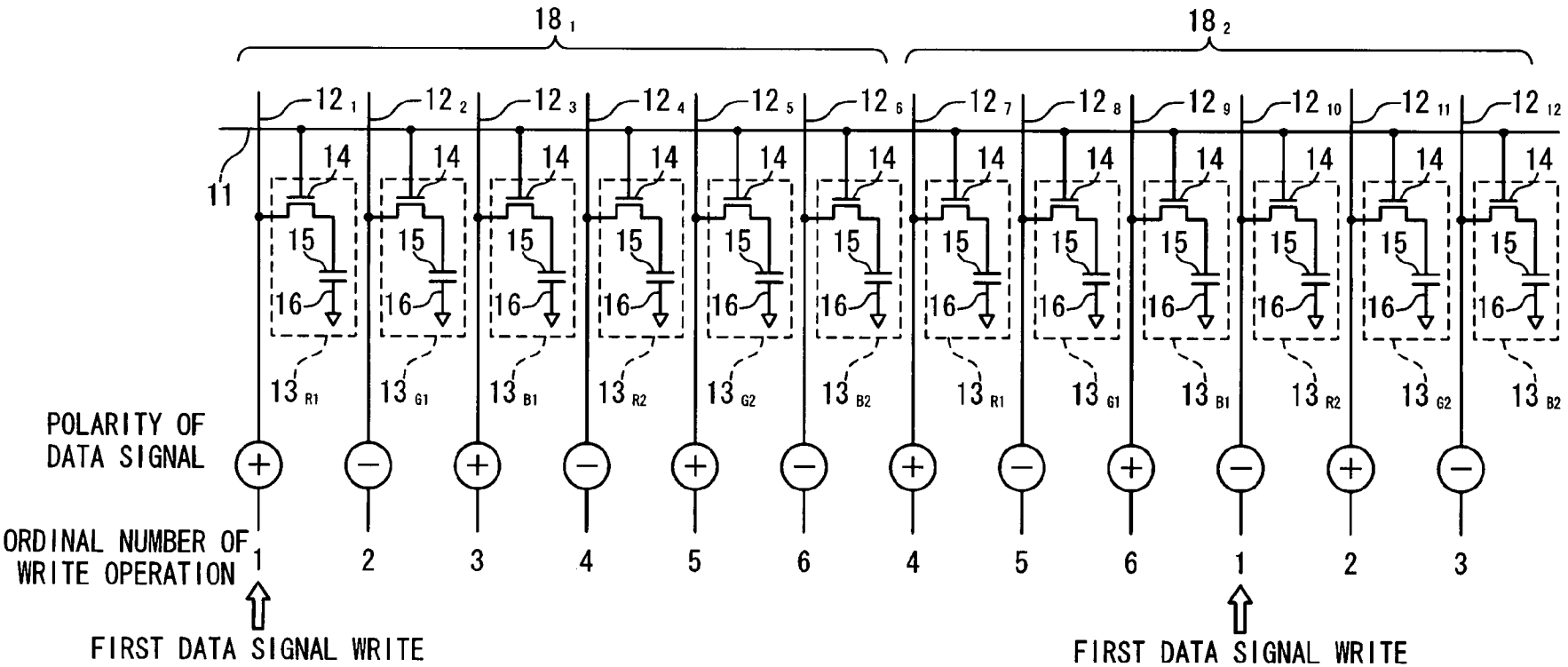
FIG. 7 is a conceptual diagram showing the polarities of data signals written into the respective pixels and the order of selecting data lines in the first embodiment.

Specifically, the LCD device 10 is designed so that the data lines 12 within the adjacent data line sets 18 are selected in different sequences to thereby satisfy the above-mentioned condition. More specifically, as shown in FIG. 7, the data lines 12 within the data line sets $\mathbf{18}_1$ are sequentially selected in the order from left to right. This results in that data-signal writing into the pixels 13 associated with the data line sets $\mathbf{18}_1$ is sequentially performed in to order from the leftmost pixel. For the data line sets $\mathbf{18}_2$ adjacent to the data line sets $\mathbf{18}_1$, on the other hand, the fourth, fifth, and sixth data lines $\mathbf{12}_{10}$, $\mathbf{12}_{11}$, and $\mathbf{12}_{12}$ from the left are sequentially selected, and the first, second, and third data lines $\mathbf{12}_7$, $\mathbf{12}_8$, and $\mathbf{12}_9$ from the left are then sequentially selected.

Figure 10:
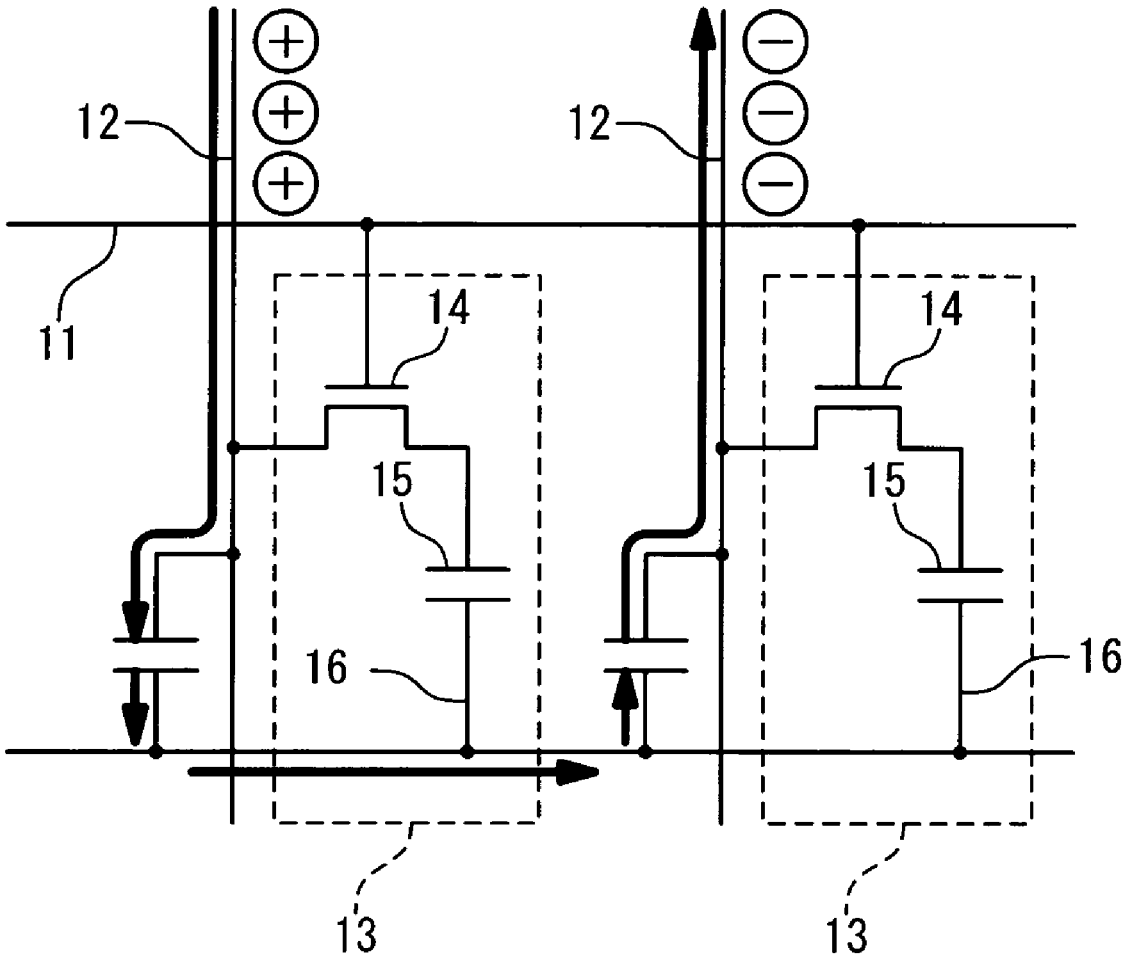
FIG. 10 a conceptual diagram showing a mechanism whereby fluctuations in the potential on the common electrode are suppressed in the first embodiment.

According to this selection sequence, the data signals of the opposite polarities are supplied to the selected data lines 12, whereby the fluctuation in the common potential $V_{COM}$ is efficiently restrained. Let us consider the pixel row (or the pixel line), for example, in which data signals of the positive polarity are written into the respective pixels 13 in the odd-numbered columns, and data signals of the negative polarity are written into the pixels 13 in the even-numbered columns. For the data line sets $\mathbf{18}_1$, the data lines $\mathbf{12}_1$ coupled to the pixels $\mathbf{13}_{R1}$, which are written with the data signals of the positive polarity, are firstly selected. For the data line sets $\mathbf{18}_2$, on the other hand, the data lines $\mathbf{12}_{10}$ coupled to the pixels $\mathbf{13}_{R2}$, which are written with the data signals of the negative polarity, are firstly selected. This allows the data lines $\mathbf{12}_1$ and $\mathbf{12}_{10}$ to be synchronously supplied with the data signals of the opposite polarity, whereby the level of the current into the common electrode 16 is restrained as shown in FIG. 10. This effectively reduces the fluctuation in the common potential $V_{COM}$. The same goes for the remaining data lines 12; the data signals of the opposite polarity are supplied to the selected data lines 12 to thereby suppress the fluctuation in the common potential $V_{COM}$.

Figure 8:
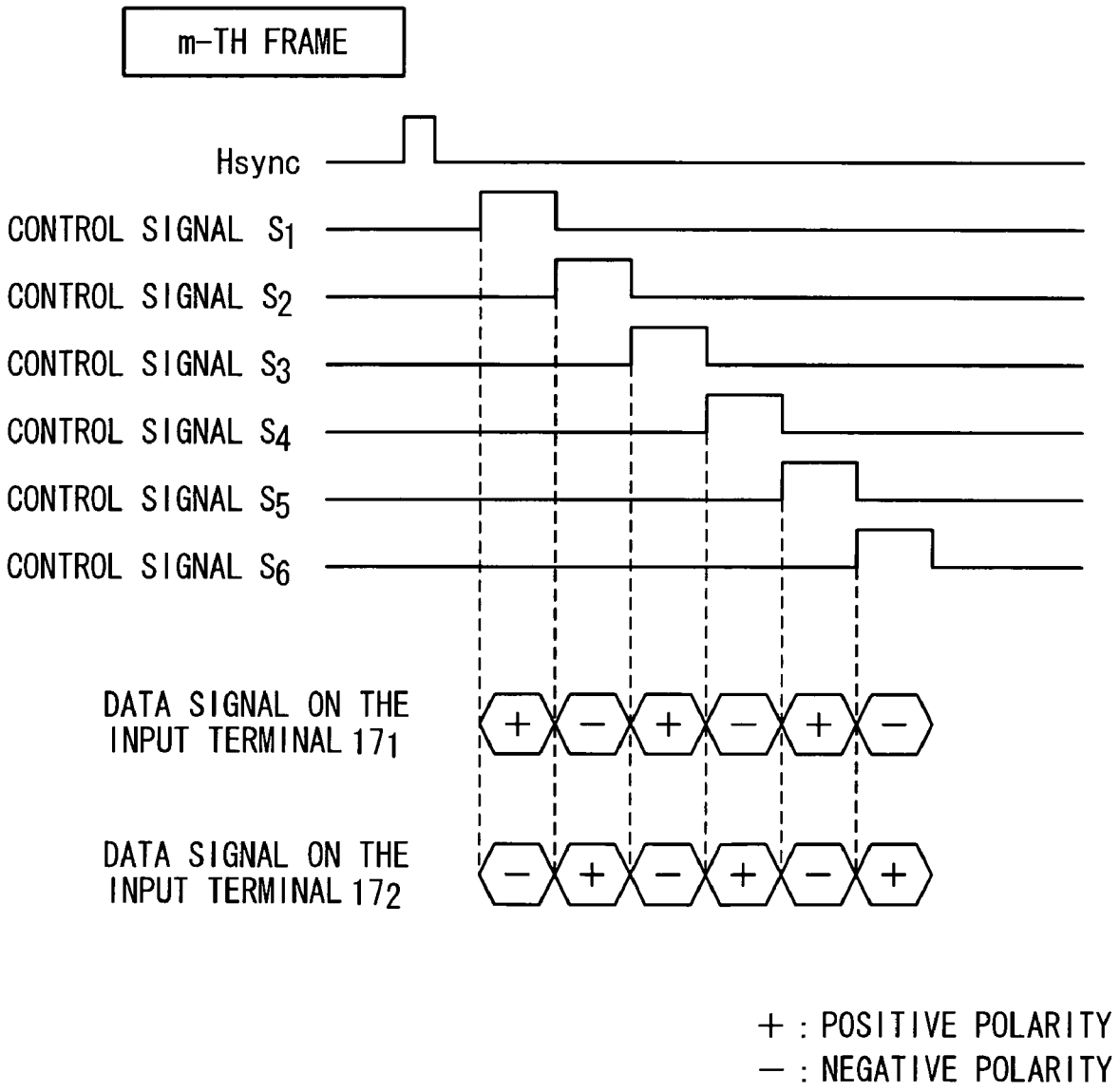
FIG. 8 is a timing chart showing waveforms of control signals and data signals supplied to an LCD panel during an m-th frame in the first embodiment.

The selection of the data lines 12 in the above-mentioned sequence is automatically accomplished through sequential activation of the control signals $S_1$ to $S_6$, as shown in FIG. 8. This is attributed to the fact that, as shown in FIG. 4, connections of the switches 19 to the control lines 21 are different between the adjacent switch sets 20. In driving the pixels 13 positioned along a certain gate line, a control signal $S_1$ is first activated. In response to the activation of the control signal $S_1$, the switches $\mathbf{19}_1$ and $\mathbf{19}_{10}$ are turned on, so that the data lines $\mathbf{12}_1$ are firstly selected within data line sets $\mathbf{18}_1$, and data lines $\mathbf{12}_{10}$ are firstly selected within data line sets $\mathbf{18}_2$. Subsequently, in response to the activation of the control signal $S_2$, the switches $\mathbf{19}_2$ and $\mathbf{19}_{11}$ are turned on to select the data lines $\mathbf{12}_2$ and $\mathbf{12}_{11}$. The similar procedure is applied to the remaining data lines 12.

More specifically, data-signal writing into the pixels 13 associated with an n-th line (i.e., the pixels 13 coupled to the gate line $\mathbf{11}_n$) is performed in the procedure described in the following.

Referring to FIG. 8, data-signal writing into the pixels 13 along the n-th line begins with activating a horizontal synchronizing signal $H_{sync}$.

Referring to FIG. 5, pixel data associated with the pixels 13 on the n-th line is forwarded to the shift register 31 in response to the activation of the horizontal synchronizing signal $H_{sync}$. The pixel data stored in the shift register 31 are then transferred to the latches 38 within the positive-side and negative-side drive circuits 34 and 35 under the control of input switch controller 42. Specifically, the pixel data associated with the pixels 13 in the odd-numbered columns are transferred to the latches 38 within the positive-side drive circuits 34, and the pixel data associated with the pixels 13 in the even-numbered columns are transferred to the latches 38 within the negative-side drive circuits 35.

Referring back to FIG. 4, the gate line $\mathbf{11}_n$ associated with the n-th line is then activated. In response to the activation of the gate line $\mathbf{11}_n$, the TFTs 14 within the pixels 13 in the n-th line are turned on, whereby the pixel electrodes 15 are electrically connected to the associated data lines 12.

Referring back to FIG. 5, data signals to be firstly written into the pixels 13 during this writing sequence are generated by the positive-side and negative-side drive circuits 34 and 35. Specifically, data signals to be written into the pixels 13 coupled to the data lines $\mathbf{12}_1$ are generated by the associated positive-side drive circuits 34, and data signals to be written into the pixels 13 coupled to the data lines $\mathbf{12}_{10}$ are generated by the associated negative-side drive circuits 35. The data-signal generation is performed in detail in a manner described in the following. In the positive-side drive circuit 34, the pixel data associated with the pixels 13 coupled to the data lines $\mathbf{12}_1$ are selected by the selectors 39 and then supplied to the D/A converters 40. The D/A converters 40 output the grayscale potential signals associated with the pixel data received from the selectors 39 to the associated amplifiers 41, and the amplifiers 41 generate the data signals having the desired potentials in response to the selected grayscale potential signals. Correspondingly, in the negative-side drive circuits 35, the pixel data for the pixels 13 coupled to the data lines $\mathbf{12}_{10}$ are selected by the selectors 39 and are then forwarded to the D/A converters 40. The D/A converters 40 output the grayscale potential signals associated with the pixel data to the associated amplifiers 41, and the amplifiers 41 generate the data signals having the desired potentials in response to the selected grayscale potential signals.

The data signals generated by the positive-side drive circuits 34 are output to the input terminals $\mathbf{17}_1$ under the control of the output switch controller 44, while the data signals generated by the negative-side drive circuits 35 are output to the input terminals $\mathbf{17}_2$. Consequently, as shown in FIG. 7, the data signals of the positive polarity to be written into the pixels 13 coupled to the data lines $\mathbf{12}_1$ are supplied to the input terminals $\mathbf{17}_1$, and the data signals of the negative polarity to be written into the pixels 13 coupled to the data lines $\mathbf{12}_{10}$ are supplied to the input terminals $\mathbf{17}_2$.

Subsequently, as shown in FIG. 8, the control signal $S_1$ is activated. This results in the turn-on of the switches $\mathbf{19}_1$ connected to the data lines $\mathbf{12}_1$, and the switches $\mathbf{19}_{10}$ connected to the data lines $\mathbf{12}_{10}$. As desired, the positive data signals generated by the positive-side drive circuits 34 are supplied to the pixel electrodes 15 within the pixels 13 coupled to the data lines $\mathbf{12}_1$ on the n-th line, and the negative data signals generated by the negative-side drive circuits 35 are supplied to the pixel electrodes 15 within the pixels 13 coupled to the data lines $\mathbf{12}_{10}$ on the n-th line.

Subsequently, the pixels coupled to the data lines $\mathbf{12}_2$ and $\mathbf{12}_{11}$, which are to be secondly driven, are then written with the associated data signals. Referring to FIG. 5, data signals to be written into the pixels 13 coupled to the data lines $\mathbf{12}_{11}$ are generated by the positive-side drive circuits 34, and data signals to be written into the pixels 13 coupled to the data lines $\mathbf{12}_2$ are generated by the negative-side drive circuits 35. In writing the pixels 13 to be secondly driven, the connections of the positive-side and negative-side drive circuits 34 and 35 to the input terminals $\mathbf{17}_1$ and $\mathbf{17}_2$ are switched by the output switch circuitry 36. This results in that the data signals to be written into the pixels 13 coupled to the data lines $\mathbf{12}_2$ are supplied from the negative-side drive circuits 35 to the input terminals $\mathbf{17}_1$, and the data signals to be written into the pixels 13 coupled to the data lines $\mathbf{12}_{11}$ are supplied from the positive-side drive circuits 34 to the input terminals $\mathbf{17}_1$. In addition, as shown in FIG. 8, the control signal $S_2$ is activated to turn on the switches $\mathbf{19}_2$ connected to the data lines $\mathbf{12}_2$ and the switches $\mathbf{19}_{11}$ connected to the data lines $\mathbf{12}_{11}$. This allows the desired data signals to be written into the pixels 13 coupled to the data lines $\mathbf{12}_2$ and the pixels 13 coupled to the data lines $\mathbf{12}_{11}$. Data-signal writing into the remaining pixels 13 on the n-th line is then performed in the similar manner.

Data-signal writing into the pixels 13 on the (n+1)-th line is performed in the same manner, except that the polarities of the data signals are inverted from those of the corresponding data signals associated with the n-th line. In order to achieve the dot inversion driving, data signals are written also into the pixels 13 on the remaining lines in the similar manner, with the polarities of the data signal inverted every two columns and every two rows.

Data-signal writing of one frame is completed through completing data-signal writing into the pixels 13 on all the lines. In the next frame, the polarity of the data signal to be written into each pixel 13 is inverted, whereby the frame inversion driving is implemented.

One problem with the above-mentioned time division driving is that the voltages developed across the liquid crystal cells within the respective pixels 13 may vary after data-signal writing into the pixels 13. The variations in the voltages across the liquid crystal cells lead to undesirable fluctuations in the grayscale levels of the pixels 13, and such fluctuations are recognized as uneven brightness by human vision on the LCD panel 1. In particular, the difference in the degrees of the voltage variations across the liquid crystal cells between the adjacent pixel columns associated with the same color causes vertical segments of uneven brightness to be recognized as patterns on the LCD panel 1, the vertical segments extending in the direction along the data lines 12. For example, the difference in the degrees of the voltage variations across the liquid crystal cells of the pixels $\mathbf{13}_{R1}$ and $\mathbf{13}_{R2}$, both associated with "R", may cause vertical segments of uneven brightness on the LCD panel 1.

There are two major causes of variations in the voltages across the liquid crystal cells. Referring to FIG. 4, the first cause is the leakage through the TFTs within the switches 19 used to select the data lines 12. The data lines 12 have a large length and a large capacitance, so that the TFTs within the switches 19 are required to have high drive capability. The TFTs designed to satisfy such requirements are formed to have a large gate width, a short gate length, and a low turn-on resistance; however, the TFTs thus designed inherently suffer large leakage. Consequently, electric charges on the pixel electrodes within the pixels 13 are discharged through the TFTs within the switches 19, and this causes undesirable variations in the voltages across the pixels 13. When the writing voltages to be supplied to the adjacent signal lines are largely different, the problem of the charge leakage is critical. The second cause of the voltage variations across the liquid crystal cells is the capacitance coupling between the data lines 12. For example, the potentials on the data lines $\mathbf{12}_1$ are varied due to the capacitance coupling between the data lines $\mathbf{12}_1$ and $\mathbf{12}_2$, when the data lines $\mathbf{12}_2$ are driven with the data signals after the data lines $\mathbf{12}_1$ are placed into the high-impedance state. The variations in the potentials on the data lines $\mathbf{12}_1$ cause fluctuations in the voltages across the pixels $\mathbf{13}_{R1}$ coupled thereto.

The pixels 13 which are earlier written with the data signals experience larger fluctuations in the voltages across the liquid crystal cells. For the case when the pixels $\mathbf{13}_{R1}$, $\mathbf{13}_{G1}$, $\mathbf{13}_{B1}$, $\mathbf{13}_{R2}$, $\mathbf{13}_{G2}$, and $\mathbf{13}_{B2}$ on a certain line associated with a certain data line set 18 are written with data signals in this order, for example, the pixel $\mathbf{13}_{R1}$, which is firstly written with the data signal, experiences the largest variation in the voltage across the liquid crystal cell.

Figure 11:
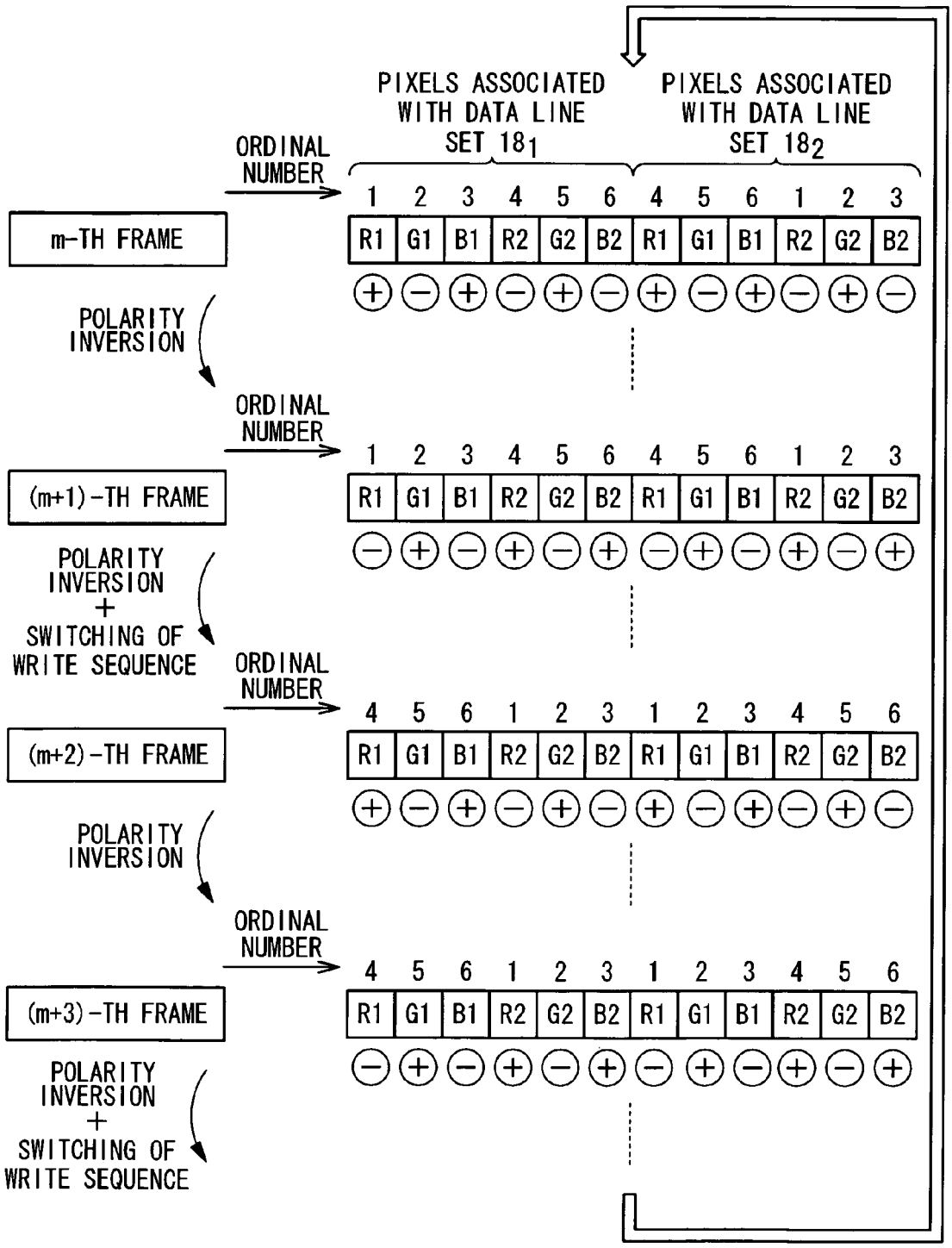
FIG. 11 is a conceptual diagram showing the polarities of data signals written into the respective pixels and the order of writing the data signals during respective frames in the first embodiment.

In order to solve the above-mentioned problem, as shown in FIG. 11, it is preferred that the order of selecting the data lines 12, that is, the order of writing the data signals into the associated pixels 13 is periodically switched. This allows the pixels 13 experiencing increased voltage variations to be temporally and specially scattered, so that the degrees of voltage fluctuations in the liquid crystal cells within the pixels 13, that is, the degrees of the grayscale level variations can be temporally and specially averaged. Averaging the degrees of the grayscale level variations enables reducing the occurrence of uneven brightness, particularly, the generation of vertical segments of uneven brightness.

In this embodiment, the polarities of the data signals supplied to the respective pixels 13 and the order of writing the pixels 13 with the data signals are switched at a cycle of four frames. Specifically, the polarities of the data signals supplied to the respective pixels 13 are inverted every frame, whereas the order of writing the data signals into the associated pixels 13 is changed every two frames. More specifically, the data-signal writing into the pixels 13 during the m-th to (m+3)-th frames is performed in the manner described below.

During the m-th frame, writing the data signals into the associated pixels 13 is performed in the manner as mentioned above. Specifically, for a certain pixel row, associated with a certain gate line 11, the data signals of the positive polarity are written into the odd-numbered column pixels 13, and the data signals of the negative polarity are written into the even-numbered column pixels 13. The writing sequence for writing data signals into the pixels 13 is different between every two adjacent data line sets $\mathbf{18}_1$ and $\mathbf{18}_2$, as described above. For example, the pixels 13 associated with the data line sets $\mathbf{18}_1$ are driven in this order of the pixels $\mathbf{13}_{R1}$, $\mathbf{13}_{G1}$, $\mathbf{13}_{B1}$, $\mathbf{13}_{R2}$, $\mathbf{13}_{G2}$, and $\mathbf{13}_{B2}$; whereas the pixels 13 associated with the data line sets $\mathbf{18}_2$ are driven in this order of the pixels $\mathbf{13}_{R2}$, $\mathbf{13}_{G2}$, $\mathbf{13}_{B2}$, $\mathbf{13}_{R1}$, $\mathbf{13}_{G1}$, and $\mathbf{13}_{B1}$.

During the (m+1)-th frame subsequent to the m-th frame, the polarities of the data signals supplied to the respective pixels 13 are inverted. The order of writing the data signals into the pixels 13 during the (m+1)-th frame is the same as that during the m-th frame.

During the (m+2)-th frame, subsequent to the (m+1)-th frame, the polarities of the data signals supplied to the respective pixels 13 are inverted, and the order of writing the data signals into the pixels 13 is switched within the respective line sets 18. In this embodiment, the order of writing the data signals into the pixels 13 are interchanged between the data line sets $\mathbf{18}_1$ and $\mathbf{18}_2$, to thereby switch the write sequence. More specifically, during the (m+2)-th frame, data-signal writing on the data line sets $\mathbf{18}_1$ is performed in this order of the pixels $\mathbf{13}_{R2}$, $\mathbf{13}_{G2}$, $\mathbf{13}_{B2}$, $\mathbf{13}_{R1}$, $\mathbf{13}_{G1}$, and $\mathbf{13}_{B1}$, whereas data-signal writing for the data line sets $\mathbf{18}_2$ is performed in this order of the pixels $\mathbf{13}_{R1}$, $\mathbf{13}_{G1}$, $\mathbf{13}_{B1}$, $\mathbf{13}_{R2}$, $\mathbf{13}_{G2}$, and $\mathbf{13}_{B2}$.

Figure 9:
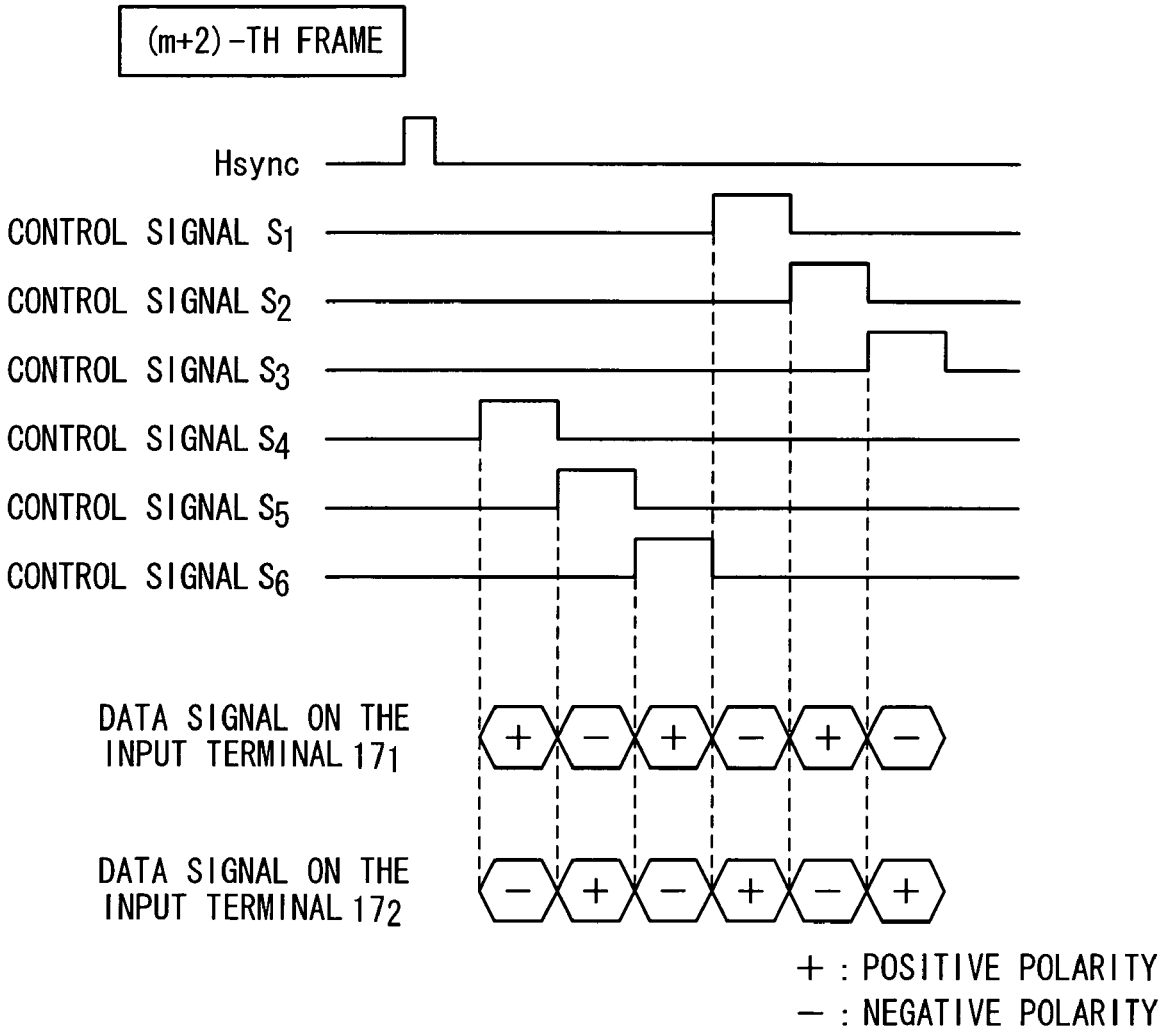
FIG. 9 is a timing chart showing waveforms of control signals and data signals supplied to the LCD panel during an (m+2)-th frame.

Switching the write sequence is achieved through changing the order of activating the control signals $S_1$ to $S_6$, as shown in FIG. 9. During the (m+2)-th frame, the control signals $S_4$ to $S_6$ are sequentially activated, and the control signals $S_1$ to $S_3$ are then sequentially activated. Thereby, data-signal writing into the respective pixels 13 is performed in the sequences mentioned above.

Referring now to FIG. 11, the fact that the order of writing the data signals into the pixels 13 associated with to the same color in the respective data line sets 18 is different between the m-th and (m+2)-th frame is important to reduce the vertical segments of uneven brightness. For example, it is now considered about the two R pixels $\mathbf{13}_{R1}$ and $\mathbf{13}_{R2}$ associated with to a certain data line set $\mathbf{18}_1$. The pixel $\mathbf{13}_{R1}$ is written with the data signal earlier than the pixel $\mathbf{13}_{R2}$ during the m-th frame, whereas the pixel $\mathbf{13}_{R2}$ is written with the data signal earlier than the pixel $\mathbf{13}_{R1}$ during the (m+2)-th frame. That is, the writing order for the pixels 13 associated with the same red color is different between the m-th and (m+2)-th frame. This is important to temporarily average the grayscale level fluctuations of the pixels 13 associated with the red color and to thereby avoid the generation of the vertical segments of uneven brightness.

During the (m+3)-th frame subsequent to the (m+2)-th frame, the polarities of the data signals supplied to the respective pixels 13 are inverted. During the (m+3)-th frame, the order of writing the data signals into the pixels 13 is the same as that in the (m+2)-th frame.

During the (m+4)-th frame subsequent to the (m+3)-th frame, the polarities of the data signals supplied to the respective pixels 13 are inverted, and the order of writing the data signals into the pixels 13 is switched within the respective data line sets 18. Consequently, the data signals are written into the pixels 13 during the (m+4)-th frame in the same manner as that that during the m-th frame. This procedure is repeated at a cycle of four frames.

As mentioned above, switching the order of writing the data signals into the pixels 13 is effective for avoid the generation of uneven brightness, particularly, the vertical segments of uneven brightness.

In an alternative embodiment, the timing when the order of writing the data signals into the pixels 13 may be modified; the switch timing is arbitrarily selectable during the four-frame cycle. For example, the order of writing may be switched at two successive frames, and the order of writing is not changed at the following two frames. It should be noted, however, that the operation shown in FIG. 11, in which the order of writing the data signals into the pixels 13 is changed every two frames, is preferable to achieve improved temporal uniformity of the grayscale level fluctuations of the respective pixels 13.

Second Embodiment

Figure 12:
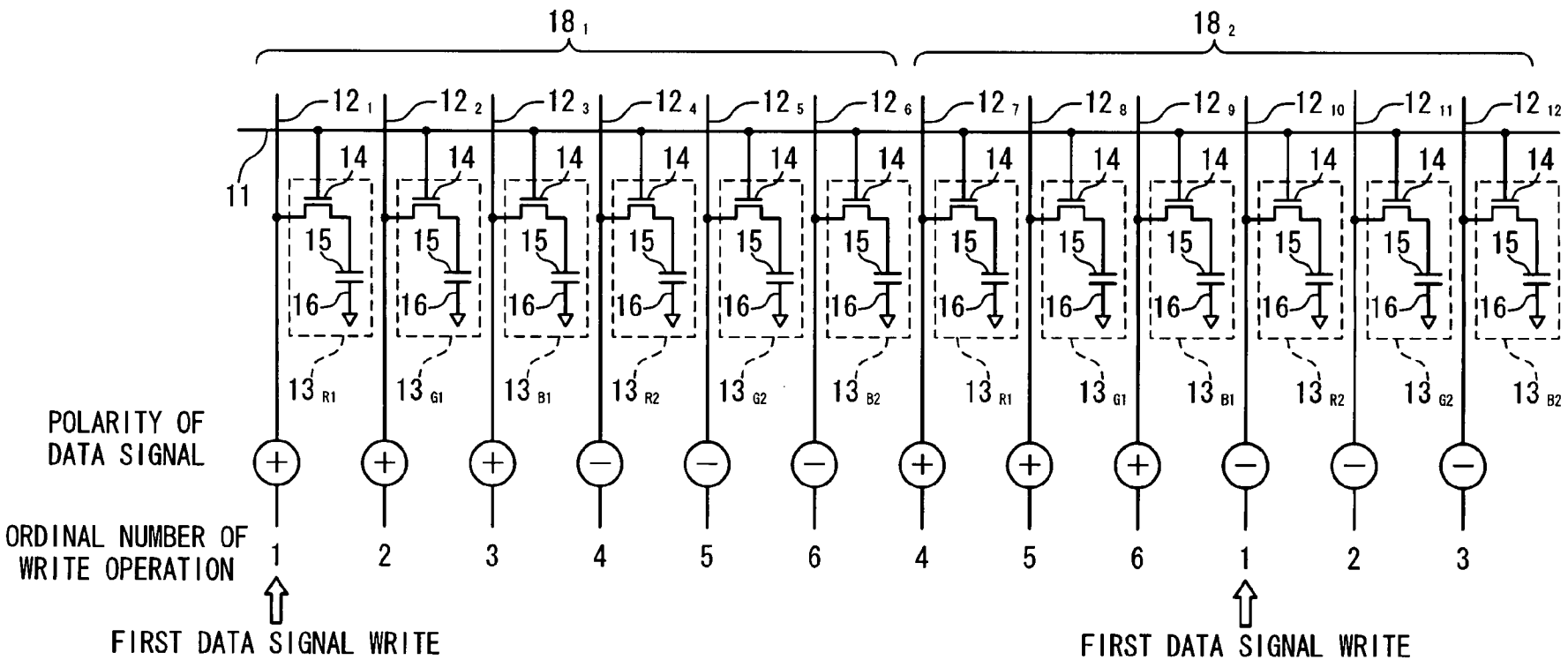
FIG. 12 is a conceptual diagram showing the polarities of data signals to be written into the respective pixels and the order of selecting data lines in a second embodiment.
Figure 13:
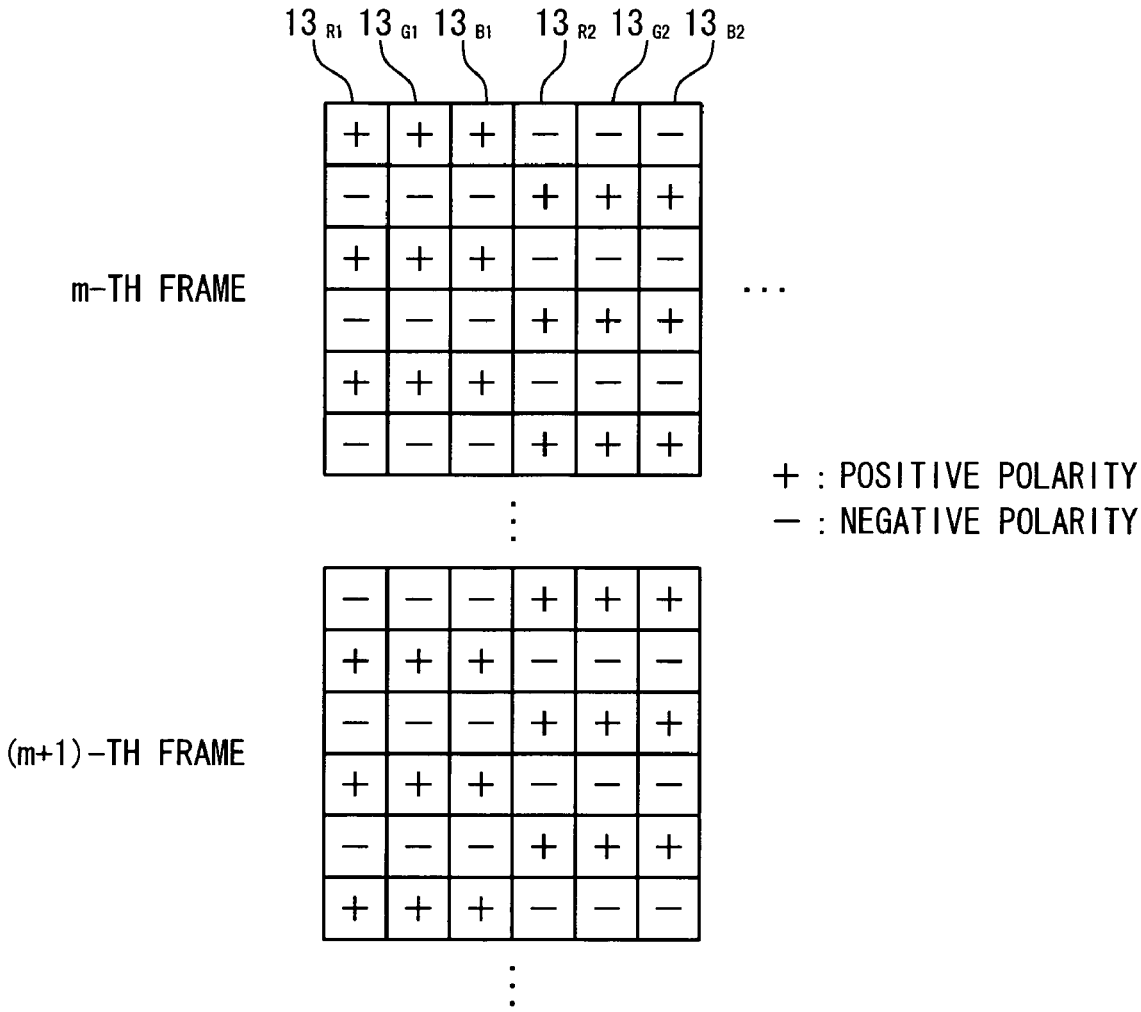
FIG. 13 is a view showing the polarities of data signals to be written into the respective pixels in the second embodiment.

FIG. 12 is a conceptual diagram showing an exemplary operation of the LCD device 10 in a second embodiment, which depicts the polarities of the data signals to be written into the respective pixels 13 and the order of selecting the data lines 12. The difference from the first embodiment is that the polarities of the data signals written into the pixels 13 are inverted every three columns in the operation in the second embodiment (also see FIG. 13); it should be noted that the write operation in the first embodiment involves inverting the polarities of the data signals written into every two pixels 13 adjacent in the horizontal direction (see FIG. 6). As shown in FIG. 12, for example, the polarities of the data signals written into the respective pixels 13 coupled to the data lines $\mathbf{12}_1$ to $\mathbf{12}_3$ are positive within the data line sets $\mathbf{18}_1$, while the polarities of the data signals written into the respective pixels 13 coupled to the data lines $\mathbf{12}_4$ to $\mathbf{12}_6$ are negative. Within the data line sets $\mathbf{18}_2$, on the other hand, the polarities of the data signals written into the respective pixels 13 coupled to the data lines $\mathbf{12}_7$ to $\mathbf{12}_9$ is positive, while the polarities of the data signals written into the respective pixels 13 coupled to data lines $\mathbf{12}_{10}$ to $\mathbf{12}_{12}$ are negative.

The order of selecting the data lines 12 in the second embodiment is the identical to that in the first embodiment; the data lines 12 are selected sequentially in the order from the left in data line sets $\mathbf{18}_1$. Thereby, data-signal writing into the pixels 13 associated with the data line sets $\mathbf{18}_1$ is performed sequentially in the order from the leftmost pixel 13. On the other hand, within the data line sets $\mathbf{18}_2$ adjacent to the data line sets $\mathbf{18}_1$, the first, second, and third data lines $\mathbf{12}_7$, $\mathbf{12}_8$, and $\mathbf{12}_9$ are selected sequentially in the order from the left, after the fourth, fifth, and sixth data lines $\mathbf{12}_{10}$, $\mathbf{12}_{11}$, and $\mathbf{12}_{12}$ are selected sequentially from the left. Thereby, for the pixels 13 associated with the data line sets $18_2$, the data signals are sequentially written into the fourth, fifth, and sixth pixels 13 from the left, and the data signals are then sequentially written into the first, second, and third pixels 13 from the left. Selecting the data lines 12 in the above-mentioned order is automatically achieved through sequentially activating the control signals $S_1$ to $S_6$ in the order shown in FIG. 14, with the connections between the switches 19 and the control lines 21 designed as shown in FIG. 4.

Figure 14:
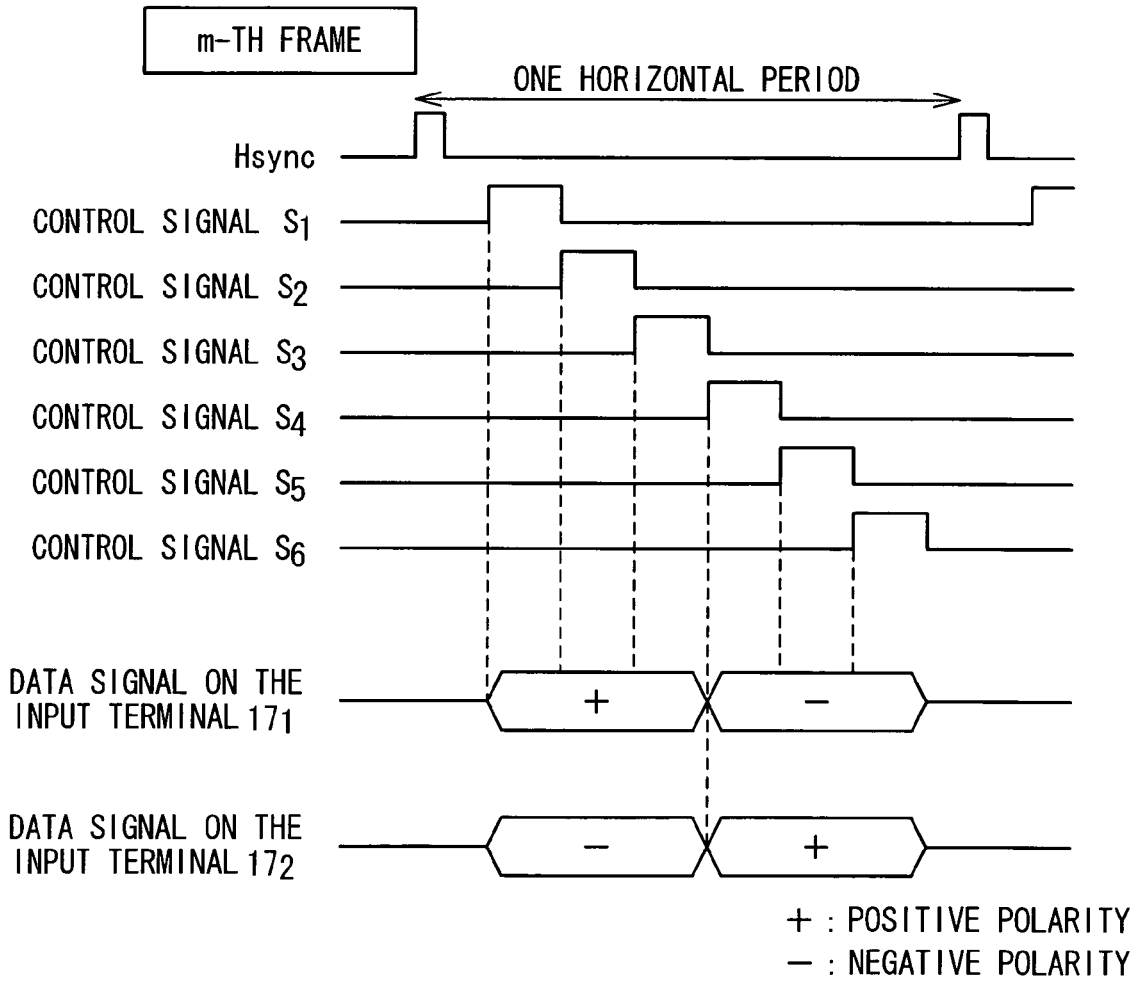
FIG. 14 is a timing chart showing waveforms of control signals and data signals supplied to the LCD panel during an m-th frame in the second embodiment.

The advantageous feature of the second embodiment is that, as shown in FIG. 14, the polarities of the data lines 12 to be written into the respective pixels 13 and the order of selecting the data lines 12 are determined so that data signals of the same polarity are successively supplied to the associated input terminals 17. This arrangement is effective to reduce the number of times the data signals to be supplied to the input terminals 17 are inverted, and to reduce the power consumption of the LCD device 10. In this embodiment, the data signals are inverted only once on the respective input terminals 17 during one horizontal period. For the data line sets $18_1$, for example, as shown in FIG. 12, the data lines $12_1$, $12_2$, and $12_3$ coupled to the pixels 13 written with positive data signals are first sequentially selected, and then the data lines $12_4$, $12_5$, and $12_6$ coupled to the pixels 13 written with negative data signals are sequentially selected. This allows reducing the number of times the data signals to be supplied to the input terminals $17_1$ are inverted during each horizontal period down to one, and thereby effectively reduces the power consumption of the LCD device 10. The same goes for the data line sets $18_2$.

The three columns of the pixels 13 to be written with the data signals of the same polarity each include one column of the pixels 13 associated with the R color, one associated with the G color, and one associated with the B color. For example, in the data line sets $18_1$, the pixels 13 to be written with data signal of the positive polarity include pixels $13_{R1}$ associated with the R color, the pixels $13_{G1}$ associated with the G color, and the pixels $13_{B1}$ associated with the B color. In addition, the pixels 13 to be written with the data signals of the negative polarity include the pixels $13_{R2}$ associated with the R color, the pixels $13_{G2}$ associated with the G color, and the pixels $13_{B1}$ associated with the B color. This arrangement is useful to avoid image quality deterioration. This is because the difference between the common potentials at the timings when the data signals are written into two pixels 13 associated with the same color is reduced. When the data signals of the same polarity are successively written into the R pixels, the G pixels, and the B pixels, the potential on the common electrode 16 may suffer from fluctuation; however, image quality deterioration due to the above-mentioned fluctuation is not easily recognizable by the user of the LCD device 10 in this embodiment, because the colors associated with the pixels 13 successively supplied with the data signals of the same polarity are different from one another.

Figure 16:
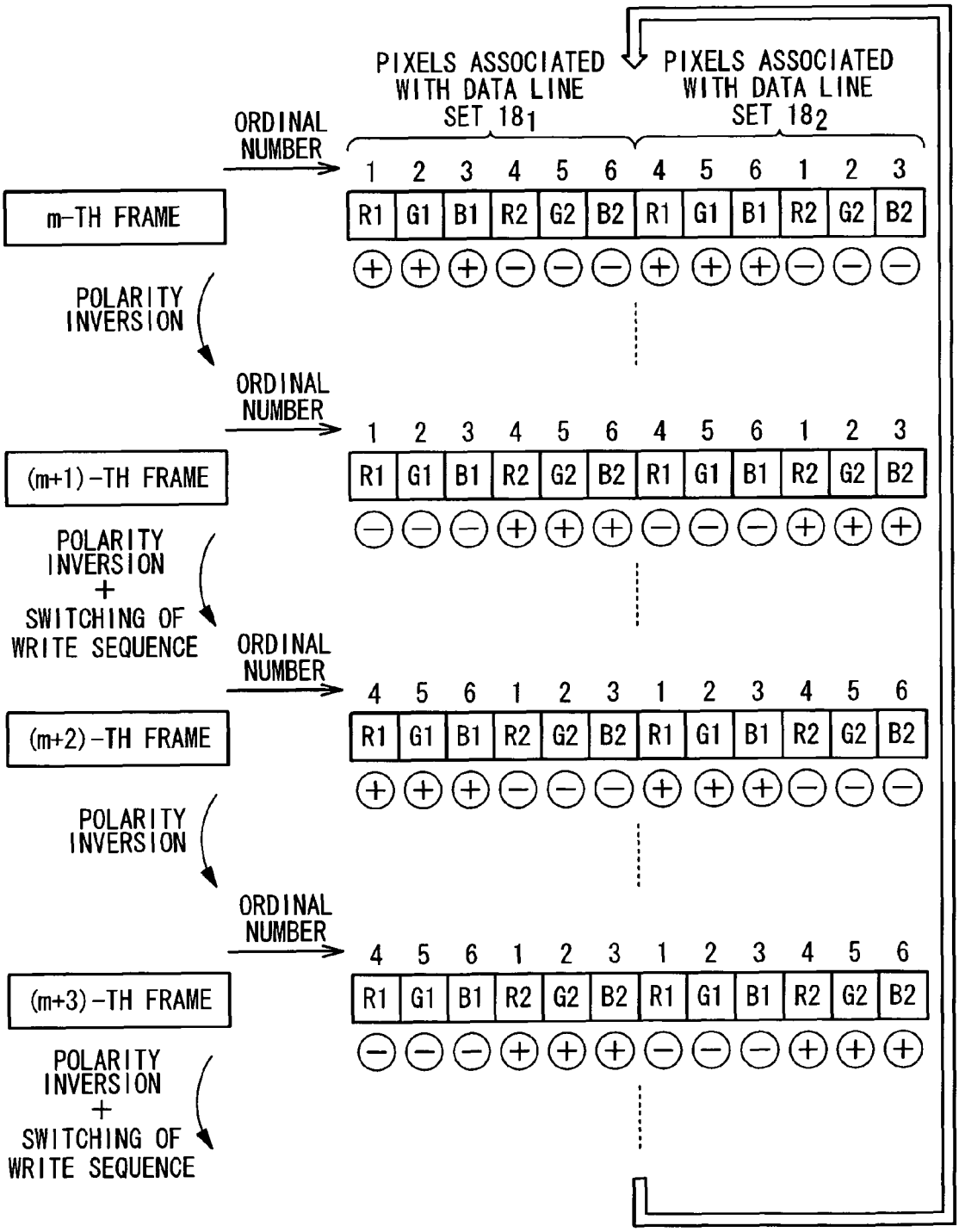
FIG. 16 is a conceptual diagram showing the polarities of the data signals to be written into the respective pixels and the order of writing the data signals thereinto during respective frames in the second embodiment.

As shown in FIG. 16, it is also preferable in this embodiment that the polarities of the data signals written into the respective pixels 13 and the order of selecting the data lines 12, i.e., the order of writing the data signals into the pixels 13 are switched at a cycle of four frames. Similarly as in the first embodiment, the polarities of the data signals supplied to the respective pixels 13 are inverted every frame, whereas the order of writing the data signals into pixels 13 is switched every two frames.

More specifically, writing the data signals into the associated pixels 13 is performed in the manner mentioned below. Writing the data signals into the pixels 13 associated with a certain gate line 11 during the m-th frame is performed in the manner mentioned above. Specifically, the polarities of the data signals written into the pixels 13 are inverted every three columns arranged in the horizontal direction. Data-signal writing into the pixels 13 associated with the data line sets $18_1$ is performed sequentially from the leftmost pixel. On the other hand, for the pixels 13 associated with the data line sets $18_2$, the fourth, fifth, and sixth pixels 13 are first sequentially written with the data signals from the left, and then the first, second, and third pixels 13 are sequentially written with the data signals from the left.

During the (m+1)-th frame, subsequent to the m-th frame, the polarities of the data signals supplied to the respective pixels 13 are inverted. The order of writing the data signals into the pixels 13 during the (m+1)-th frame is the same as that during the m-th frame.

Figure 15:
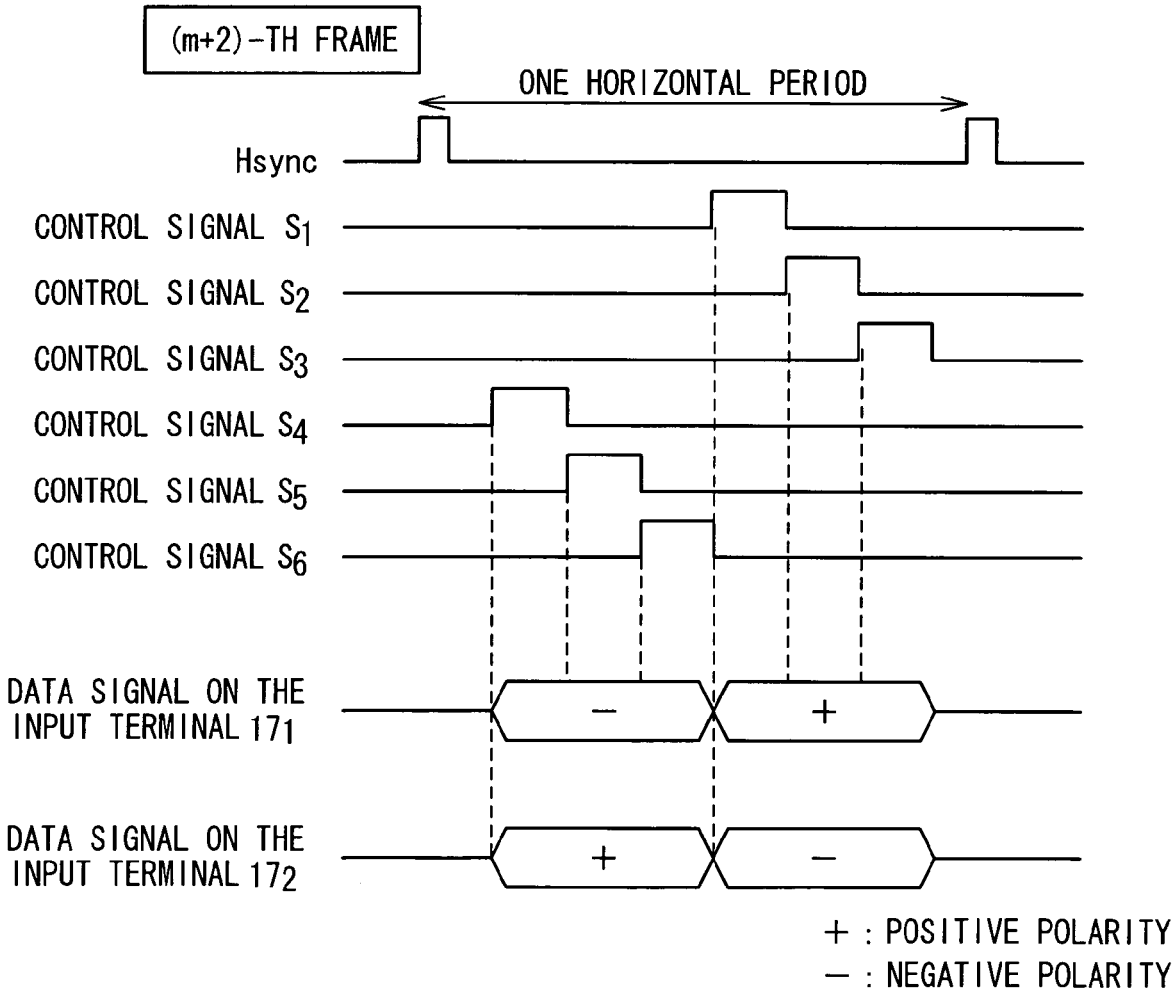
FIG. 15 is a timing chart showing waveforms of the control signals and the data signals supplied to the LCD panel during an (m+2)th frame in the second embodiment.

During the (m+2)-th frame, subsequent to the (m+1)-th frame, the polarities of the data signals supplied to the respective pixel 13 are inverted, while the order of writing the data signals into the pixels 13 is switched within the respective line sets 18. In this embodiment, the write sequences for writing the pixels 13 are interchanged between the data line sets $18_1$ and $18_2$, to thereby switch the order of data-signal writing. More specifically, during the (m+2)-th frame, data-signal writing on the data line sets $18_1$ is performed in this order of the pixels $13_{R2}$, $13_{G2}$, $13_{B2}$, $13_{R1}$, $13_{G1}$, and $13_{B1}$, whereas data-signal writing for the data line sets $18_2$ is performed in this order of the pixels $13_{R1}$, $13_{G1}$, $13_{B1}$, $13_{R2}$, $13_{G2}$ and $13_{B2}$. Switching the write sequence is achieved through changing the order of activating the control signals $S_1$ to $S_6$, as shown in FIG. 15. During the (m+2)-th frame, the control signals $S_4$ to $S_6$ are sequentially activated, and then the control signals $S_1$ to $S_3$ are sequentially activated. This achieves writing the data signals into the respective pixels 13 in the desired sequence described above.

As is shown in FIG. 16, during the (m+3)-th frame, subsequent to the (m+2)-th frame, the polarities of the data signals supplied to the respective pixels 13 are inverted. During the (m+3)-th frame, the order of writing the data signals into the pixels 13 is the same as that in the (m+2)-th frame.

During the (m+4)-th frame, subsequent to the (m+3)-th frame, the polarities of the data signals supplied to respective pixels 13 are inverted, and the order of writing the data signals into the pixels 13 is switched within the respective data line sets 18. Consequently, during the (m+4)-th frame, subsequent to the (m+3)-th frame, the data signals are written into the pixels 13 in the same manner as that during the m-th frame. The same goes for the following frames, so that the polarities of the data signals and the order of writing the data signals into the pixels 13 are switched at a cycle of four frames.

Third Embodiment

Figure 17:
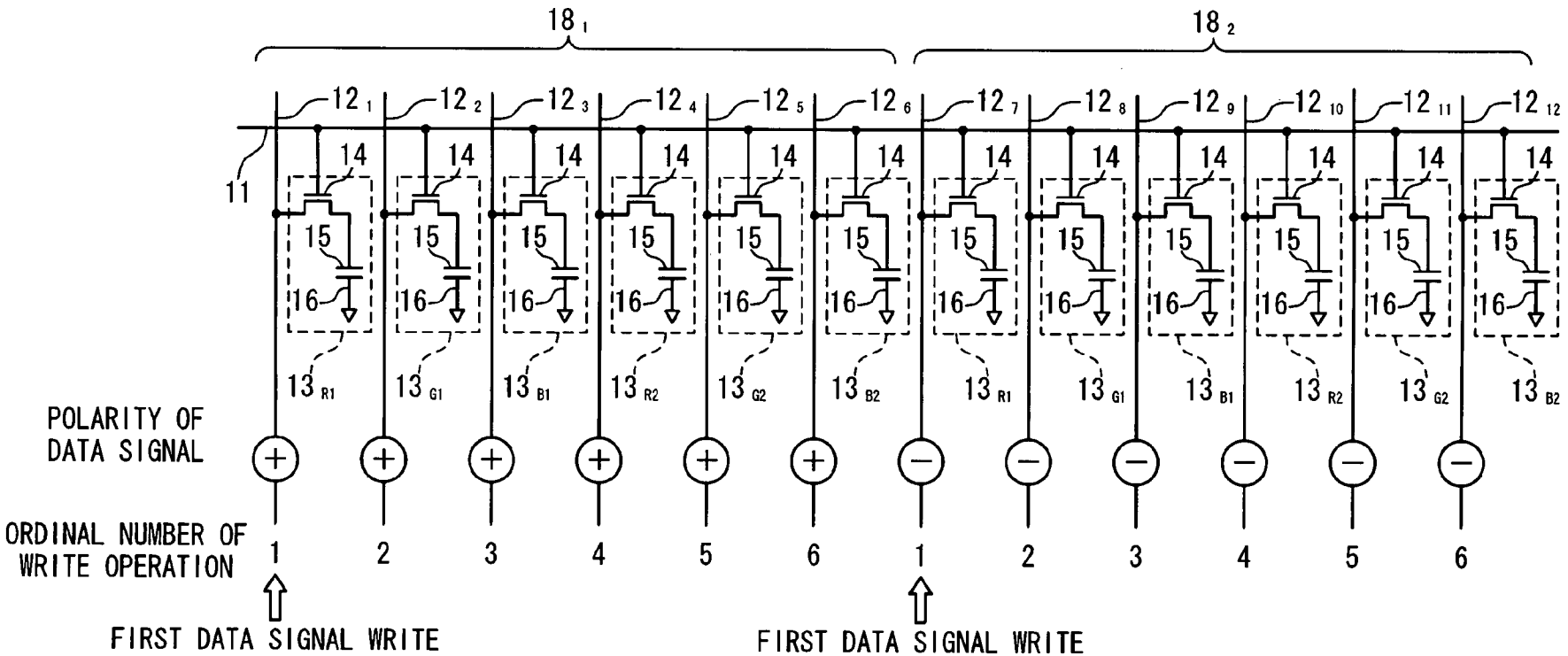
FIG. 17 is a conceptual diagram showing the polarities of the data signals to be written into the respective pixels and the order of selecting the data lines in a third embodiment.
Figure 19:
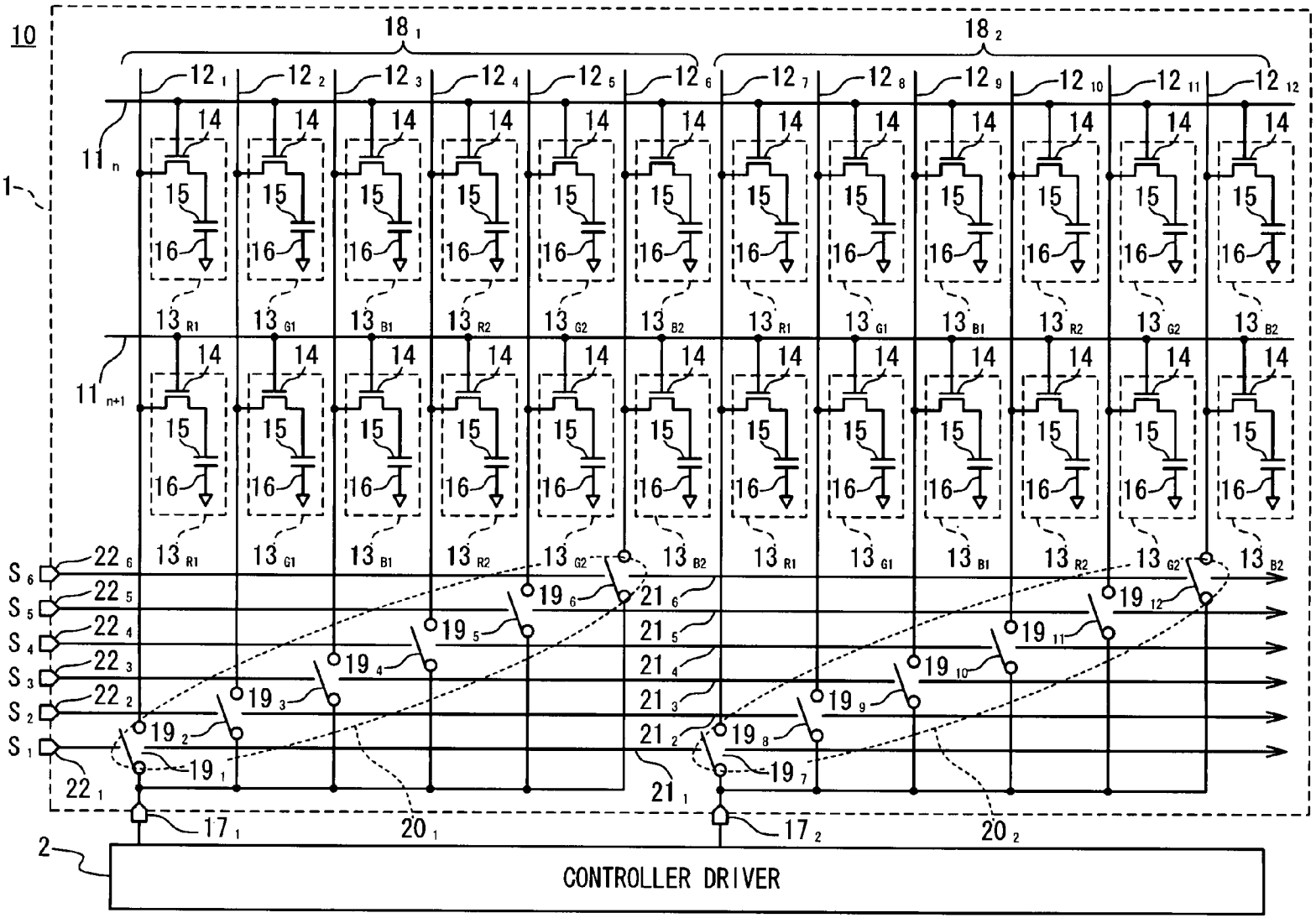
FIG. 19 is a block diagram showing another exemplary structure of the LCD device that can be employed in the third embodiment.

FIG. 17 is a conceptual diagram illustrating an exemplary operation of the LCD device 10 in a third embodiment, which depicts the polarities of the data signals written into the respective pixels 13 and the order of selecting the data lines 12. In this embodiment, the polarities of the data signals written into the pixels 13 are inverted in units of the data line sets 18, that is, in units of six columns (also see FIG. 18). More specifically, the polarities of the data signals written into the pixels 13 associated with the adjacent data line sets 18 are opposite, while the polarities of the data signals to be written into the pixels 13 associated with the same data line sets 18 are the same. As shown in FIG. 18, the polarities of the data signals written into the respective pixels 13 are inverted every pixel rows (or every pixel line). This effectively allows the data signals of opposite polarities to be applied to two data lines 12 respectively selected from the adjacent data line sets 18, whereby the potential variation on the common electrode 16 is reduced.

Figure 20:
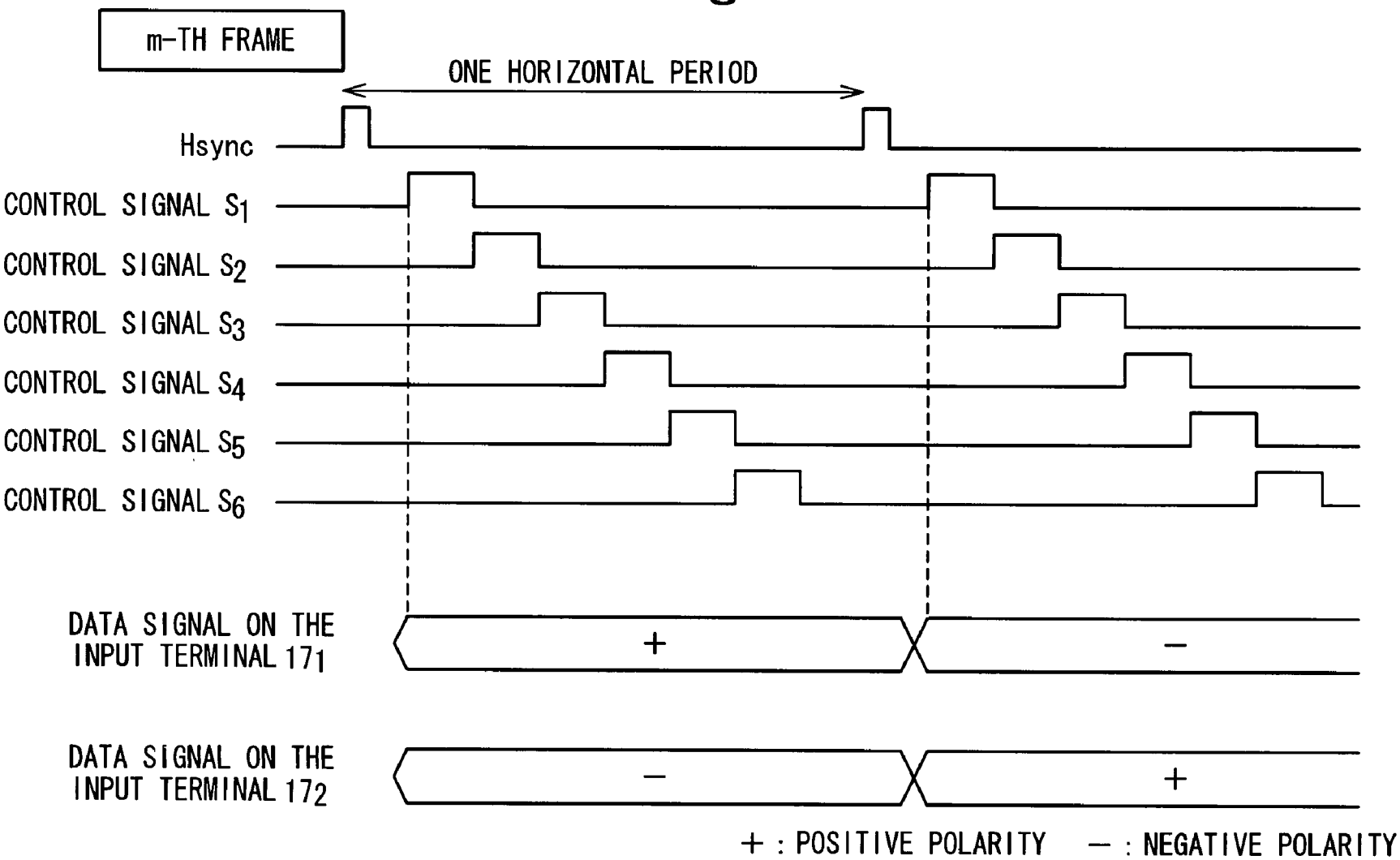
FIG. 20 is a timing chart showing waveforms of the control signals and the data signals supplied to the LCD panel during an m-th frame in the third embodiment.

As shown in FIG. 20, one advantage of the operation of the LCD device 10 in the third embodiment is to eliminate the necessity for inverting the potentials on the respective input terminals 17 in the middle of one horizontal period, and to thereby further reduce the power consumption of the LCD device 10. For example, in a certain horizontal period, the polarities of the data signals written into the pixels 13 associated with the data line sets $\mathbf{18}_1$ are all positive, while the polarities of the data signals written into the pixels 13 associated with the data line sets $\mathbf{18}_2$ are negative. During this horizontal period, the polarities of all the data signals applied to the data lines 12 associated with the data line sets $\mathbf{18}_1$ are positive, and the polarities of all the data signals associated with the data line sets $\mathbf{18}_2$ are negative. Accordingly, the potentials on the input terminals $\mathbf{17}_1$ remain positive, and the potential of the input terminals $\mathbf{17}_2$ remain negative during the relevant horizontal period, so that the potentials on input terminals $\mathbf{17}_1$, $\mathbf{17}_2$ are not inverted. This allows further reducing the power consumption of LCD device 10.

In this embodiment, the order of selecting the data lines 12 can be arbitrarily determined in units of the data line sets 18. The data signals of the opposite polarity are applied to the data lines 12 selected regardless of the order of selecting the data lines 12, because the polarities of the data signals written into the associated pixels 13 are inverted in units of the data line sets 18. For example, as shown in FIG. 17, the order of selecting the data lines 12 in the adjacent data line sets 18 may be the same. In this case, the connections between the switches 19 and the control lines 21 are configured to be identical in all the switch sets 20. In one embodiment, the switches $\mathbf{19}_1$ to $\mathbf{19}_6$ may be connected to the control lines $\mathbf{21}_1$ to $\mathbf{21}_6$, and the switches $\mathbf{19}_7$ to $\mathbf{19}_{12}$ may be connected to the control lines $\mathbf{21}_1$ to $\mathbf{21}_6$. In this case, as shown in FIG. 20, the data lines 12 are sequentially selected in the order from left to right in both of the data line sets $\mathbf{18}_1$ and $\mathbf{18}_2$, in response to sequential activation of the control signals $S_1$ to $S_6$.

Figure 22:
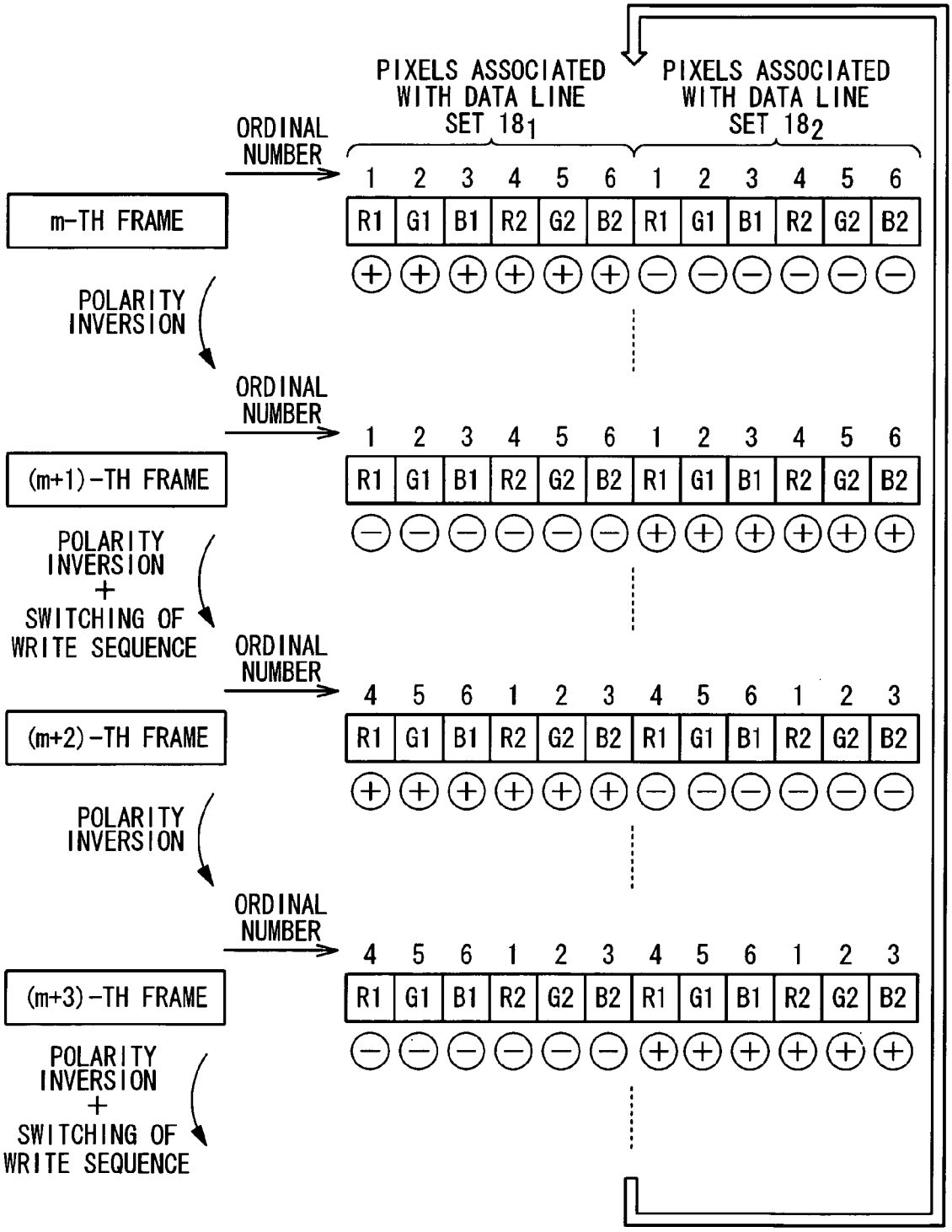
FIG. 22 is a conceptual view showing the polarities of the data signals to be written into the respective pixels and the order of writing the data signals thereinto during respective frames in the third embodiment.

As shown in FIG. 22, it is also preferable in this embodiment that the polarities of the data signals written into the respective pixels 13 and the order of selecting the data lines 12, i.e., the order of writing the data signals into the associated pixels 13 are switched at a cycle of four frames. Similarly as in the first embodiment, the polarities of the data signals supplied to the associated pixels 13 are inverted every frame, whereas the order of writing the data signals into the pixels 13 is switched every two frames.

More specifically, data-signal writing into the pixels 13 is performed as described in following. Data-signal writing into pixels 13 during the m-th frame is performed in the manner mentioned above. Specifically, the polarities of the data signals written into the pixels 13 are inverted in units of the data line sets 18. Data-signal writing into the pixels 13 associated with the data line sets $\mathbf{18}_1$ and $\mathbf{18}_2$ is sequentially performed in the order from the leftmost pixel.

During the (m+1)-th frame subsequent to the m-th frame, the polarities of the data signals supplied to the respective pixels 13 are inverted. The order of for writing the data signals into the associated pixels 13 during the (m+1)-th frame is the same as that during the m-th frame.

During the (m+2)-th frame subsequent to the (m+1)-th frame, the polarities of the data signals supplied to the respective pixels 13 are inverted, and the order of writing the data signals into the pixels 13 is switched within the respective line sets 18. In this embodiment, the order of selecting the data lines is switched so that the ordinal numbers of the three left-side data lines 12 and the ordinal numbers of the three right-side data lines 12 are interchanged within the respective data line sets 18. Specifically, for the data line set $\mathbf{18}_1$, the three right-side data lines $\mathbf{12}_4$ to $\mathbf{12}_6$ are firstly sequentially selected, and the three left-side data lines $\mathbf{12}_1$ to $\mathbf{12}_3$ are then sequentially selected. The same goes for the data line set $\mathbf{18}_2$; the three right-side data lines $\mathbf{12}_4$ to $\mathbf{12}_6$ are firstly sequentially selected, and three left-side data lines $\mathbf{12}_1$ to $\mathbf{12}_3$ are then sequentially selected.

Figure 21:
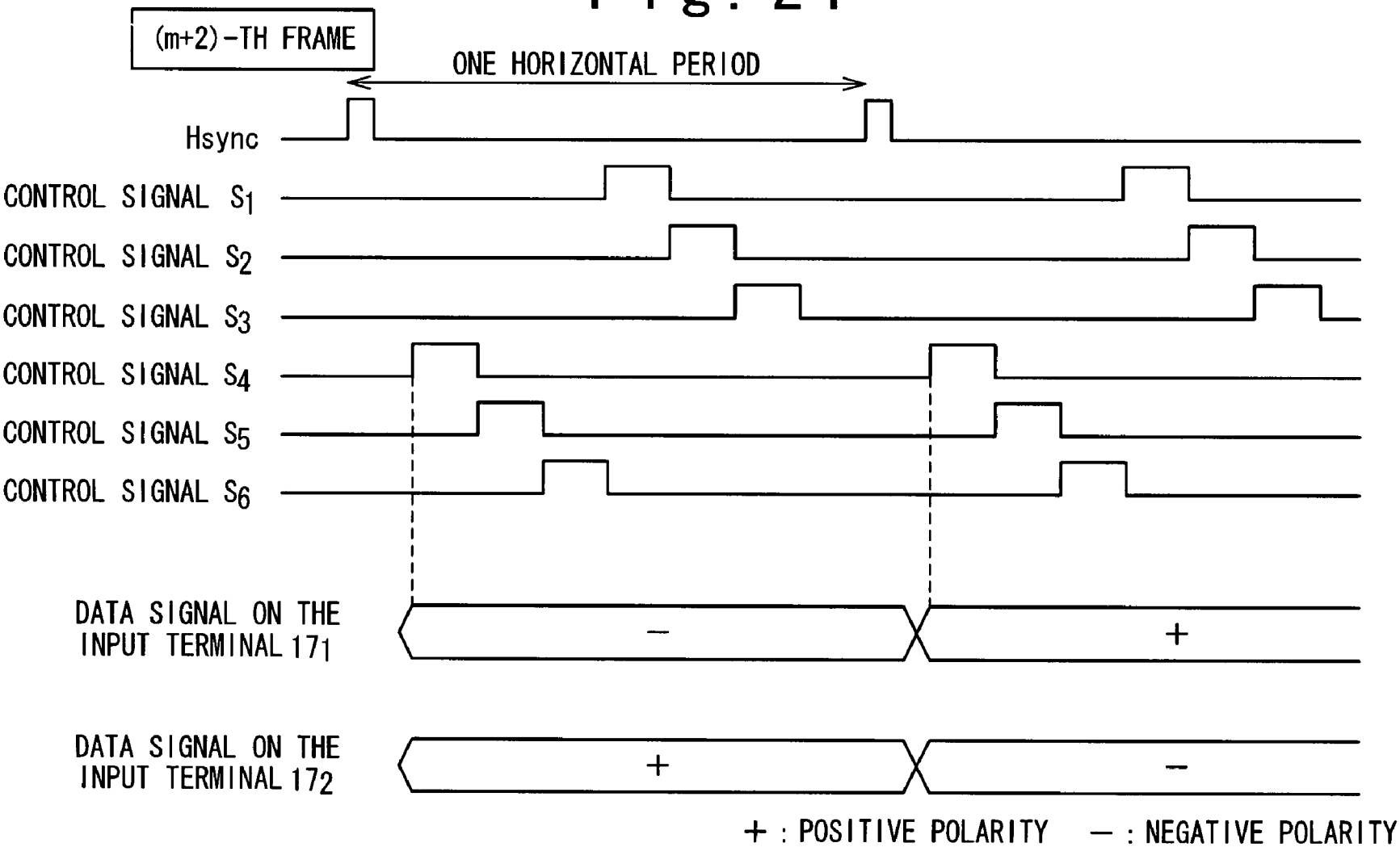
FIG. 21 is a timing chart showing waveforms of the control signals and the data signals supplied to the LCD panel during an (m+2)-th frame in the third embodiment.

The order of writing the data signals is switched through changing the order of activating the control signals $S_1$ to $S_6$, as shown in FIG. 21. During the (m+2)-th frame, the control signals $S_4$ to $S_6$ are sequentially activated, and the control signals $S_1$ to $S_3$ are then sequentially activated. This procedure achieves writing the data signals into the respective pixels 13 in the desired order.

During the (m+3)-th frame subsequent to the (m+2)th frame, as shown in FIG. 22, the polarities of the data signals supplied to the respective pixels 13 are inverted, while the order of writing the writing data signals into the pixels 13 is the same as that in the (m+2)-th frame.

During the (m+4)-th frame subsequent to the (m+3)th frame, the polarities of the data signals supplied to the respective pixels 13 are inverted, and the order for writing the data signals into the pixels 13 is switched within the respective data line sets 18. Consequently, during the (m+4)-th frame subsequent to the (m+3)-th frame, the data signals are written into pixels 13 in the same manner as that during the m-th frame. The same goes for the following frames, so that the polarities of the data signals and the order of writing the data signals into the pixels 13 are switched at a cycle of four frames.

Fourth Embodiment

Figure 23:
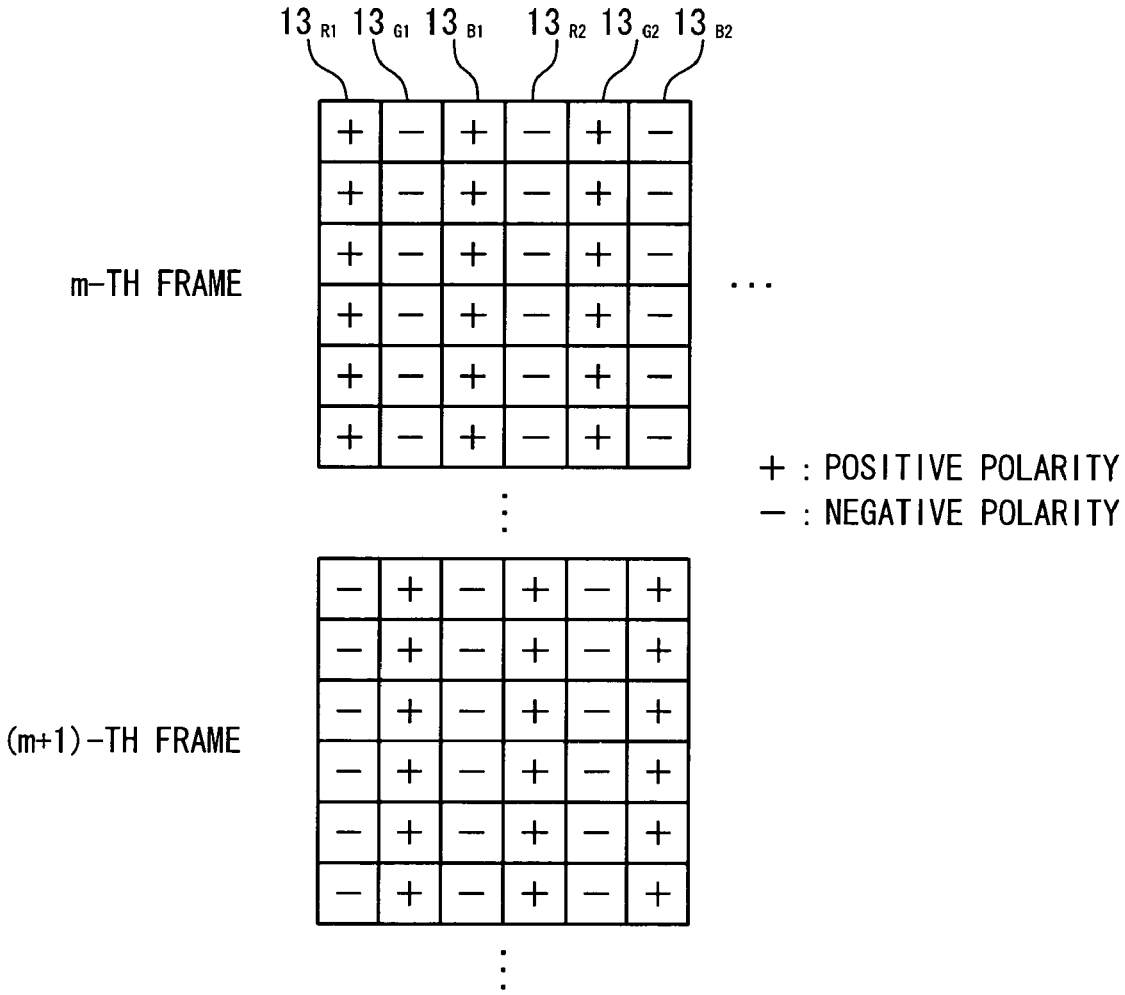
FIG. 23 is a conceptual diagram showing the polarities of the data signals to be written into respective pixels in a fourth embodiment.

In a fourth embodiment, as shown in FIG. 23, vertical inversion driving (V-line inversion driving) is performed. Specifically, data signals of one polarity are supplied to the pixels 13 in the same column, and data signals of the opposite polarity are supplied to the pixels 13 in the adjacent column. The sequence for selection of the data lines 12 is the same that of the first embodiment. Those skilled in the art would understand that the use of vertical inversion driving in place of dot inversion driving also satisfies the condition that data signals of the opposite polarities are concurrently applied to the selected data lines 12 for the same reasons as those described in the first embodiment, whereby effectively suppressing the fluctuation in the common potential $V_{COM}$. The use of vertical inversion driving is preferable for effectively reducing the power consumption of the LCD device 10, and for further stabilizing the common potential $V_{COM}$.

Figure 24:
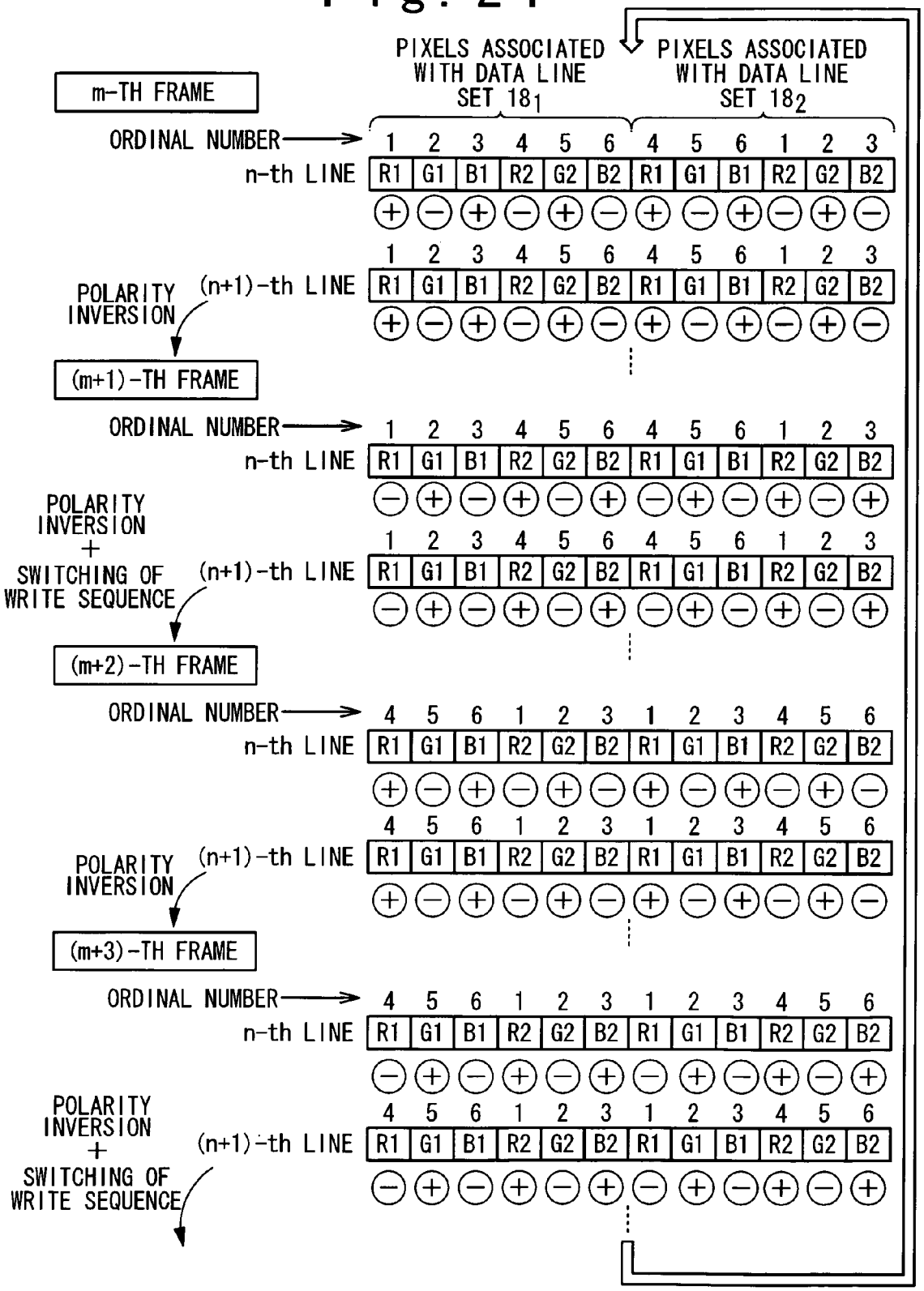
FIG. 24 is a conceptual diagram showing the polarities of the data signals to be written into respective pixels and the order of writing the data signals thereinto during respective frames in the fourth embodiment.

Referring to FIG. 24, as is the case of the first to third embodiments, the operation in this embodiment may involve switching the polarities of the data signals written into the respective pixel 13*s* and the order of writing the data signals into the pixels 13 at the four-frame cycle. In this case, the polarities of the data signals supplied to the respective pixels 13 are inverted every frame, whereas the order of writing the data signals into the pixels 13 is switched every two frames. Those skilled in the art would easily implement these modifications.

CONCLUSION

As described above, the LCD device 10 disclosed in any one of the first to fourth embodiments effectively reduces the fluctuations in the common potential $V_{COM}$ (that is the potential on the common electrode 16) within the respective pixels 13 even when the number of the data lines 12 to be time-divisionally driven is an even number, through optimization of the polarities of the data signals written into the respective pixels 13 and the order of selecting the data lines 12. The thus-designed architecture provides concurrent implementation of the inversion driving according to the common constant driving and the time-division driving scheme for the LCD device 10 in which the number of data lines 12 to be time-divisionally driven is an even number.

Furthermore, the order of selecting the data lines 12, that is, the order of for writing the data signals into the pixels 13 are switched at a certain period, to thereby avoid the generation of uneven brightness, especially vertical segments of uneven brightness, attributed to the voltage fluctuations across the liquid crystal cells.

It is apparent that the present invention is not limited to the above-described embodiments, which may be modified and changed without departing from the scope of the invention.

What is claimed is:

1. A method of driving a liquid crystal display panel including first and second data line sets each including an even number of arrayed data lines, and a plurality of pixels sharing a common electrode having a constant potential, said method comprising:

time-divisionally selecting data lines from each of said first and second data line sets; and providing data signals on said selected data lines to write said data signals into said pixels therethrough, wherein the data lines of the first data line set are commonly connected to a first input node provided on the liquid crystal display panel, the data lines of the second data line set are commonly connected to a second input node provided on the liquid crystal display panel, the data signals associated with the pixels connected to the data lines of the first data line set are fed through the first input node, and the data signals associated with the pixels connected to the data lines of the second data line set are fed through the second input node, wherein the time-divisional selection of the data lines from each of the first and second data line sets and the providing of the data signals on the selected data lines are performed in each horizontal period, wherein each of data lines of the first data line set is adjacent to another data line of the first data line set and each of data lines of the second data line set is adjacent to another data line of the second data line set, wherein each of the data lines of the first and second data line sets are selected at different times during each horizontal period;

wherein data lines associated with same color are selected from said first and second data line sets at same time, wherein polarities of data signals on the data lines selected at the same time are opposite to each other, wherein a color pattern of the pixels connected to the data lines of the first data set in a scan line direction is same as a color pattern of the pixels connected to the data lines of the second data line set in the scan line direction, and wherein each of a plurality of control lines time-divisionally selects the data lines from each of said first and second data line sets and each of the respective control lines are associated with the same color in the first and second data line sets.

2. The method according to claim 1, wherein an order of selecting said data lines from said first data line set is different from that of selecting said data lines from said second data line set during a horizontal period.

3. The method according to claim 2, wherein said time-divisionally selecting includes selecting i-th data line of said first data line set and j-th data line of said second data line set, i being not equal to j.

4. The method according to claim 2, wherein said order of selecting said data lines from said first data line set is determined so that data signals of the same polarity are successively written into associated one of said pixels associated with said first data line set.

5. The method according to claim 4, wherein said order of selecting said data lines from said first data line set is determined so that data signals of a first polarity are successively written into associated ones of said pixels, and data signals of a second polarity opposite to said first polarity are then successively written into remaining ones of said pixels.

6. The method according to claim 5, wherein said order of selecting said data lines from said second data line set is determined so that data signals of said second polarity are successively written into associated ones of said pixels, and data signals of said first polarity are then successively written into remaining ones of said pixels.

7. The method according to claim 1, wherein data signals written into all of said pixels associated with said first data line set have a first polarity during a horizontal period, and data signals written into all of said pixels associated with said second data line set have a second polarity opposite to said first polarity during said horizontal period.

8. The method according to claim 1, wherein an order of selecting said data lines from said first data line set during a first frame is different from that of selecting said data lines from said first data line set during a second frame.

9. The method according to claim 8, wherein an order of selecting said data lines from said second data line set during said first frame is different from that of selecting said data lines from said second data line set during said second frame.

10. The method according to claim 8, wherein polarities of said data signals written into said pixels are inverted every frame.

11. The method according to claim 10, wherein said order of selecting said data lines from said first and second data line sets are switched at a cycle of multiple frames.

12. A method of driving a liquid crystal display panel including first and second data line sets each including an even number of arrayed data lines, and a plurality of pixels sharing a common electrode having a constant potential, said method comprising:

time-divisionally selecting data lines from each of said first and second data line sets; and providing data signals for said selected data lines to write said data signals into said pixels therethrough, wherein data signals written into all of said pixels associated with said first data line set have a first polarity during a horizontal period, and data signals written into all of said pixels associated with said second data line set have a second polarity opposite to said first polarity during said horizontal period, wherein the data lines of the first data line set are commonly connected to a first input node provided on the liquid crystal display panel, the data lines of the second data line set are commonly connected to a second input node provided on the liquid crystal display panel, the data signals associated with the pixels connected to the data lines of the first data line set are fed through the first input node, and the data signals associated with the pixels connected to the data lines of the second data line set are fed through the second input node, wherein the time-divisional selection of the data lines from each of the first and second data line sets and the providing of the data signals on the selected data lines are performed in each horizontal period, wherein each of data lines of the first data line set is adjacent to another data line of the first data line set and each of data lines of the second data line set is adjacent to another data line of the second data line set, wherein each of the data lines of the first and second data line sets are selected at different times during each horizontal period, wherein data lines associated with same color are selected from said first and second data line sets at same time, wherein polarities of data signals on the data lines selected at the same time are opposite to each other, and wherein a color pattern of the pixels connected to the data lines of the first data set in a scan line direction is same as a color pattern of the pixels connected to the data lines of the second data line set in the scan line direction, and wherein each of a plurality of control lines time-divisionally selects the data lines from each of said first and second data line sets and each of the respective control lines are associated with the same color in the first and second data line sets.

13. A liquid crystal display device comprising:

first and second data line sets each including an even number of data lines;

a plurality of pixels sharing a common electrode having a constant potential;

a selector circuit designed to time-divisionally select data lines from each of said first and second data line sets, to electrically connect said data line selected from said first data line set with a first input, and to electrically connect said data line selected from said second data line set with a second input; and a driver circuit providing first and second data signals on said first and second inputs, respectively, in synchronization with time divisional selection of said data lines, to thereby write said first and second data signals into associated ones of said pixels, wherein an order of selecting said data lines and polarities of said data signals written into said associated ones of said pixels are determined so that said first and second data signals have opposite polarities, wherein the data lines of the first data line set are commonly connected to a first input node provided on the liquid crystal display panel, the data lines of the second data line set are commonly connected to a second input node provided on the liquid crystal display panel, the data signals associated with the pixels connected to the data lines of the first data line set are fed through the first input node, and the data signals associated with the pixels connected to the data lines of the second data line set are fed through the second input node, wherein the time-divisional selection of the data lines from each of the first and second data line sets and the providing of the data signals on the selected data lines are performed in each horizontal period, wherein each of data lines of the first data line set is adjacent to another data line of the first data line set and each of data lines of the second data line set is adjacent to another data line of the second data line set, wherein each of the data lines of the first and second data line sets are selected at different times during each horizontal period, wherein data lines associated with same color are selected from said first and second data line sets at same time, wherein polarities of data signals on the data lines selected at the same time are opposite to each other, wherein a color pattern of the pixels connected to the data lines of the first data set in a scan line direction is same as a color pattern of the pixels connected to the data lines of the second data line set in the scan line direction, and wherein each of a plurality of control lines of the selector circuit time-divisionally selects the data lines from each of said first and second data line sets and each of the respective control lines are associated with the same color in the first and second data line sets.

14. The liquid crystal display device according to claim 13, wherein said selector circuit selects said data lines from each of said first and second data line sets so that an order of selecting said data lines from said first data line set is different from that of selecting said data lines from said second data line set during a horizontal period.

15. The liquid crystal display device according to claim 13, wherein said first data signals written into said pixels associated with said first data line set have a first polarity during a horizontal period, and said second data signals written into said pixels associated with said second data line set have a second polarity opposite to said first polarity during said horizontal period.

16. A liquid crystal display device comprising:

a first and second data line sets each including an even number of data lines;

a plurality of pixels sharing a common electrode having a constant potential;

a selector circuit designed to time-divisionally select data lines from each of said first and second data line sets, to electrically connect said data line selected from said first data line set with a first input, and to electrically connect said data line selected from said second data line set with a second input; and a driver circuit providing first and second data signals on said first and second inputs, respectively, in synchronization with time divisional selection of said data lines, to thereby write said first and second data signals into associated ones of said pixels, wherein data signals written into all of said pixels associated with said first data line set have a first polarity during a horizontal period, and data signals written into all of said pixels associated with said second data line set have a second polarity opposite to said first polarity during said horizontal period, wherein the data lines of the first data line set are commonly connected to a first input node provided on the liquid crystal display panel, the data lines of the second data line set are commonly connected to a second input node provided on the liquid crystal display panel, the data signals associated with the pixels connected to the data lines of the first data line set are fed through the first input node, and the data signals associated with the pixels connected to the data lines of the second data line set are fed through the second input node, wherein the time-divisional selection of the data lines from each of the first and second data line sets and the providing of the data signals on the selected data lines are performed in each horizontal period, wherein each of data lines of the first data line set is adjacent to another data line of the first data line set and each of data lines of the second data line set is adjacent to another data line of the second data line set, wherein each of the data lines of the first and second data line sets are selected at different times during each horizontal period, wherein data lines associated with same color are selected from said first and second data line sets at same time, wherein polarities of data signals on the data lines selected at the same time are opposite to each other, wherein a color pattern of the pixels connected to the data lines of the first data set in a scan line direction is same as a color pattern of the pixels connected to the data lines of the second data line set in the scan line direction, and wherein each of a plurality of control lines time-divisionally selects the data lines from each of said first and second data line sets and each of the respective control lines are associated with the same color in the first and second data line sets.

17. A liquid crystal display panel comprising:

a gate line;

first to n-th data lines arrayed in a horizontal direction along said gate line, n being an even number;

(n+1)-th to (2n)-th data lines arrayed in a horizontal direction along said gate line;

a plurality of pixels disposed at respective intersections of said gate line and said first to n-th data lines;

a first input node;

a second input node;

first to n-th switches connected between said first input node and said first to n-th data lines;

(n+1)-th to (2n)-th switches connected between said second input node and said (n+1)-th to (2n)-th data lines; and first to n-th control signal lines arrayed in a vertical direction for receiving first to n-th control signals, wherein said first to n-th switches are connected to said first to n-th control lines, respectively, and wherein i-th switch selected out of said (n+1)-th to (2n)-th switches is connected to a control signal line other than i-th signal line of said first to n-th control signal lines, wherein the selection of the data lines from each of the first to n-th data lines and (n+1)-th to (2n)-th data lines and provision of the data signals on the selected data lines are performed in each horizontal period, wherein each of data lines of the first to n-th data lines is adjacent to another data line of the first to n-th data lines and each of data lines of the and (n+1)-th to (2n)-th data lines is adjacent to another data line of the and (n+1)-th to (2n)-th data lines, wherein each of the data lines of the first to n-th data lines and (n+1)-th to (2n)-th data lines are selected at different times during each horizontal period wherein data lines associated with same color are selected from said first to n-th data lines and (n+1)-th to (2n)-th data lines at same time, wherein polarities of data signals on the data lines selected at the same time are opposite to each other, wherein a color pattern of the pixels connected to the data lines of the first to n-th data lines in a scan line direction is same as a color pattern of the pixels connected to the data lines of the (n+1)-th to (2n)-th data lines in the scan line direction, and wherein each of a plurality control lines time-divisionally selects each of the first to n-th data lines and (n+1)-th to (2n)-th data lines and each of the respective control lines are associated with the same color in the first to n-th data lines and (n+1)-th to (2n)-th data lines.

18. The method according to claim 1, wherein each of the data lines from the first data line sets are selected in a sequential order, one after another, during each horizontal period.

19. The method according to claim 18, wherein each of the data lines from the first data line sets are sequentially selected starting from the data line corresponding to the left most pixel associated with the first data line set.

20. The method according to claim 1, wherein the color patterns for the first and second data lines sets are repeating patterns consisting of an odd number of colors.

21. The method according to claim 20, wherein the odd number of colors are red green and blue.

* * * * *